US005845467A

United States Patent [19]

Guardiola

[11] Patent Number: 5,845,467

[45] Date of Patent: Dec. 8, 1998

[54] BAG-PACKAGING MACHINE

[75] Inventor: Agustin Dauder Guardiola, Badalona, Spain

[73] Assignee: Talleres Daumar S.A.

[21] Appl. No.: 530,605

[22] Filed: Sep. 20, 1995

[30] Foreign Application Priority Data

Sep. 20, 1994 [ES] Spain ..... 9401978

[51] Int. Cl.[6] ..... B65B 43/44

[52] U.S. Cl. ..... 53/571; 53/284.7; 53/384.1; 53/385.1

[58] Field of Search ..... 53/570, 571, 572, 53/573, 284.7, 373.4, 385.1, 384.1, 386.1

[56] References Cited

U.S. PATENT DOCUMENTS

| | | | |
|---|---|---|---|
| 3,889,449 | 6/1975 | Membrino | 53/572 |
| 4,291,517 | 9/1981 | Lipes | 53/573 |
| 4,370,845 | 2/1983 | Perolls et al. | 53/573 |
| 5,006,196 | 4/1991 | Vandevoorde | 53/585 |
| 5,029,728 | 7/1991 | Su | 53/571 |
| 5,457,944 | 10/1995 | Lipes | 53/572 |
| 5,495,707 | 3/1996 | Lauzon | 53/572 |

FOREIGN PATENT DOCUMENTS

| | | | |
|---|---|---|---|
| 2207651 | 2/1989 | United Kingdom | 53/284.7 |

*Primary Examiner*—John Sipos
*Assistant Examiner*—John Paradiso
*Attorney, Agent, or Firm*—Birch, Stewart, Kolasch & Birch, LLP

[57] ABSTRACT

A bag-packaging machine has four pincers with a vertical flange and two oblique flaps which define an octagonal shape. The distance of these elements with regard to a central axis of this octagonal shape is governed, simultaneously and in synchronization, by regulator. A folding chute its provided. The chute is pivotable about a longitudinal lateral axis and is centered with respect to the axis of the octagonal shape. A securing and elevation device is provided for the upper part of a bag, a cutting and securing device is provided to separate the bags and a gathering device is provided for the bags.

2 Claims, 27 Drawing Sheets

BAG-PACKAGING MACHINE

FIELD OF THE INVENTION

The purpose of the current invention patent is to improve the bag-packaging machines used for various products, especially fruits, vegetables, foodstuffs of all kinds, and, generally, any product or object which needs to be packaged in bags, usually of a predetermined total weight or amount.

STATE OF THE ART

Bag-packaging machines for various products are well known; among the different machines are those which use some bags, generally made of plastic or similar material, which have a rim at the top of each bag and an extension at the periphery of the rim, normally half the size of the rim. This rim has two openings for hanging and, at a certain distance and over the same, there are vertical pre-cut slits for facilitating their later removal from the hanging mechanism. Obviously these bags can be made of other conventional materials and can also have openings in the body for ventilating their contents.

The latter bag-packaging machines in use today have, on the whole, some means (located at the entrance of the machine) of temporary storage for the bags to be filled, which are hanging by the openings in their rims; some means of unit feeding of the bags, that is, which supplies the bags one by one; some means of opening and securing by the mouth of a bag—including the rim—; some means of discharging the products to be packaged into the interior of the bag; some means of transferring the already filled bag to some means of tightening them at their neck; and some means of closing the bag with a fastening element, and some means of transporting the already filled and closed bag toward the exit of the machine. All these packaging machines receive the product to be packaged in the corresponding bags of the other machine, such as a weighing machine or unit counter, either directly from said machines or through some intermediate transportation means between those machines and the bag-packaging machines.

Among such bag-packaging machines in use is the LOCKPACK MULTI MC-8P type LOCKWOOD machine with the WBS-3 bag filling system marketed by the U.S. firm VOLM BAG, CO., INC., as well as the net bag-packaging machine MSU/2,000 of the U.S. firm YAKIMA WIRE WORKS, INC.

In the bag-packaging machines in use, the mouth of the bag to be filled is secured in two places, which produces mechanical tension which require bags with relatively high resistance, thereby preventing the use of bags which are thin or have little resistance; at the same time, the chute in these machines which is used for the temporary holding of the product and its discharge into the corresponding bags is fixed in place and must be taken apart in order to gain access to the machinery or to adjust, repair, or clean the parts, and, finally, the finish of the already filled and closed bags is irregular.

SUMMARY OF THE INVENTION

With the purpose of correcting the shortcomings found in the bag-packaging machine in use as described above, and at the same time to provide some advantages which will be highlighted further on, some improvements in bag-packaging machines are proposed in the current invention. This invention includes means, located at the entrance of the machine, of temporary storage of the bags to be filled, hanging by openings in a protruding rim of each bag, some means of unit feeding of the bags, some means of opening and securing the mouth of a bag, some means of discharging the product to be packaged into the interior of the bag, some means of transferring the already filled bag to some means of gathering them at the neck to be closed, and some means of closing the bag with the corresponding fastening element, as well as some means of transporting the bag toward the exit of the machine. The improvements are characterized by the following:

a) The means of opening and securing the mouth of the bag has two pairs of pincers, each located along vertical and perpendicular planes, with the pincers from each pair placed opposite one another, and one of said vertical planes coinciding with the central longitudinal plane of the machine;

b) the front pincer is fixed and has two parallel horizontal rods which are positioned toward the entrance of the machine, providing some means of suspending the bags to be filled;

c) this front pincer consists of a vertical flange with two oblique flaps which diverge toward the rear pincer;

d) each mobile part, which acts as a joint on a respective horizontal axis of the rear pincer and of the two side pincers, has a vertical flange with two oblique flaps diverging toward the opposite pincer;

e) the flange of the front pincer and the flanges of the mobile parts of the three remaining pincers form an octagonal shape;

f) the four pincers are mounted on a mechanism of simultaneous and synchronized regulation in terms of distance to the central vertical geometric axis of said octagonal shape whose geometric axis remains fixed; and g) the mechanism for discharging the product to be packaged has a folding chute around a lateral longitudinal axis; this chute can be superimposed over the mouth of the bag to be filled and is centered with regard to said central vertical geometric axis, and thus the chute has a means of support in the structure of the machine and means for its functioning.

Thus, and as an option, such improvements are characterized by presenting some means of securing and elevation in their upper part, positioned over the fastening element of the filled and closed bag, as well as with some means of cutting and temporary securing of said upper part of the bag and some means of gathering in this upper part activated by blowing.

The application of the improvements of the bag-packaging machines of the type described, which is the purpose of this invention, eliminates the highlighted inconveniences pertaining to the machines in use and provides, among other things, certain advantages.

For example, the specific means of opening and securing the mouth of the bag allow for the use of bags with low resistance, that is, of very thin density without breakage during handling in the machine. The folding chute, which can be mounted to the right or left of the machine, facilitates access to the machinery to adjust, repair, and/or clean the parts and allows the chute to be mounted according to the requirements of the installation where the machine is located. The means of securing and elevation of the upper part of the filled and closed bag, the means of cutting and securing this upper protruding part of the bag, and the corresponding means of gathering said part allow for tightening the bag around the product it contains, with a better finish of the same with a view to its later marketing.

Said improvements, according to this invention, besides others which can be easily deduced from the example of a case of implementation of the improvements described further on to facilitate the understanding of the characteristics highlighted previously and at the same time permitting the understanding of various details of the same, accompanied for said purpose by drawings in which, solely as an example and not limiting the range of the invention, represent a practical case of a bag-packaging machine with the improvements according to the invention.

DESCRIPTION OF PERFORMANCE ACCORDING TO THE INVENTION

Figure 1:
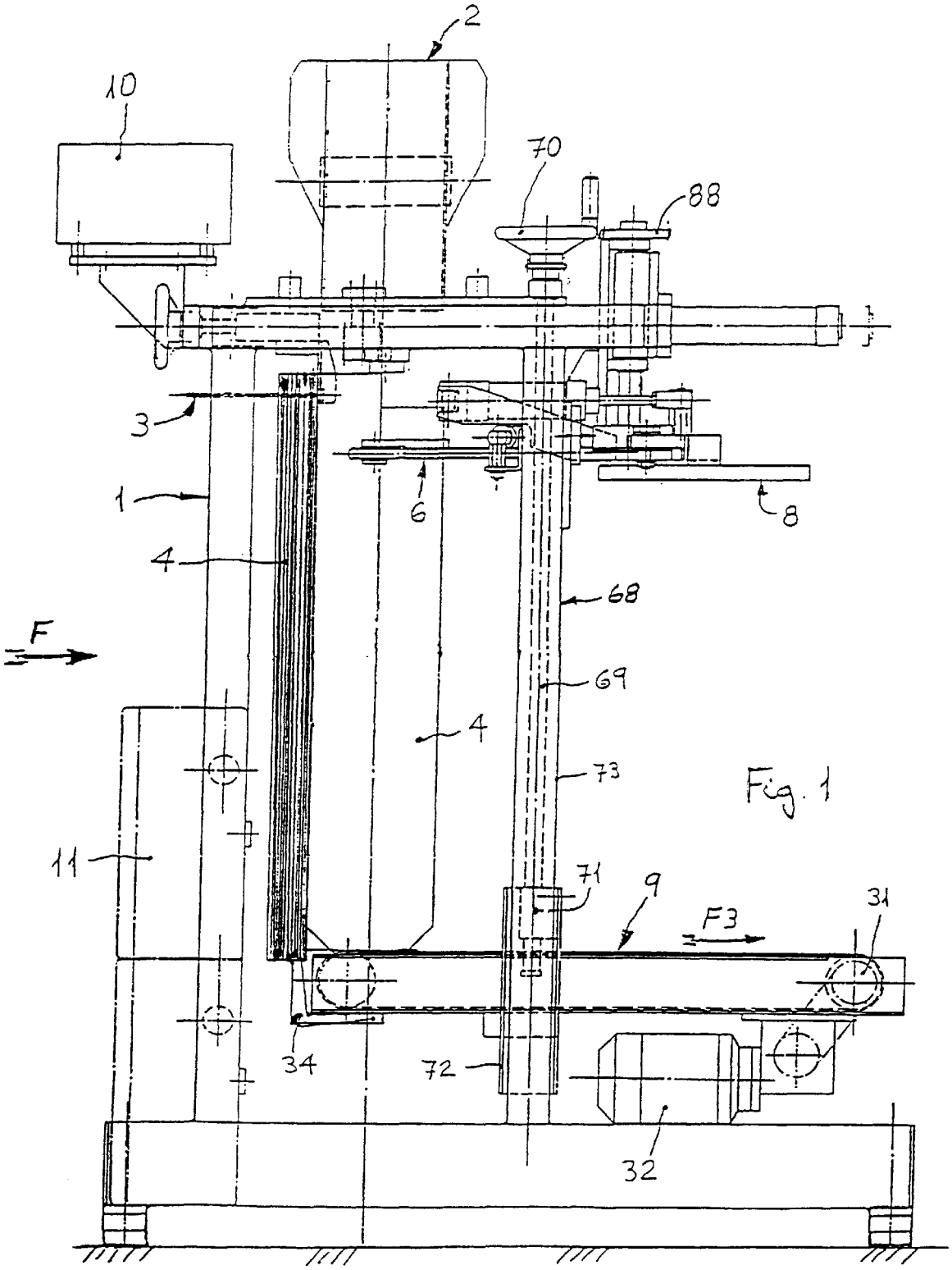
FIG. 1 shows a right side view of a machine according to the present invention.

According to the drawings, the bag-packaging machine with the improvements according to the invention have a structure (1) (FIGS. 1 through 9, 11 through 13, and 17 through 25) of support of the elements of the machine with its corresponding supporting legs on the floor (FIGS. 1 and 2) which will have the means of regulation for keeping the machine level and eventual methods of mounting the machine to the floor. The machine also has a chute (2) (FIGS. 1 through 4), some means of temporary storage (3) of the bags (4) (FIGS. 1, 2, 5, 6, 7, and 8), some upper means of transporting (6) the bags (FIGS. 1, 11, 12, 13, 21, 23, 24, and 28), some means of opening and securing (5) the bags (FIG. 8), some means of gathering (7) of the upper part of the bags (FIGS. 17 and 18), some means of closing (8) the bags (FIGS. 1, 21, and 22), and some means of lower transportation (9) of the bags (FIGS. 1, 2, and 14 through 16).

Figure 2:
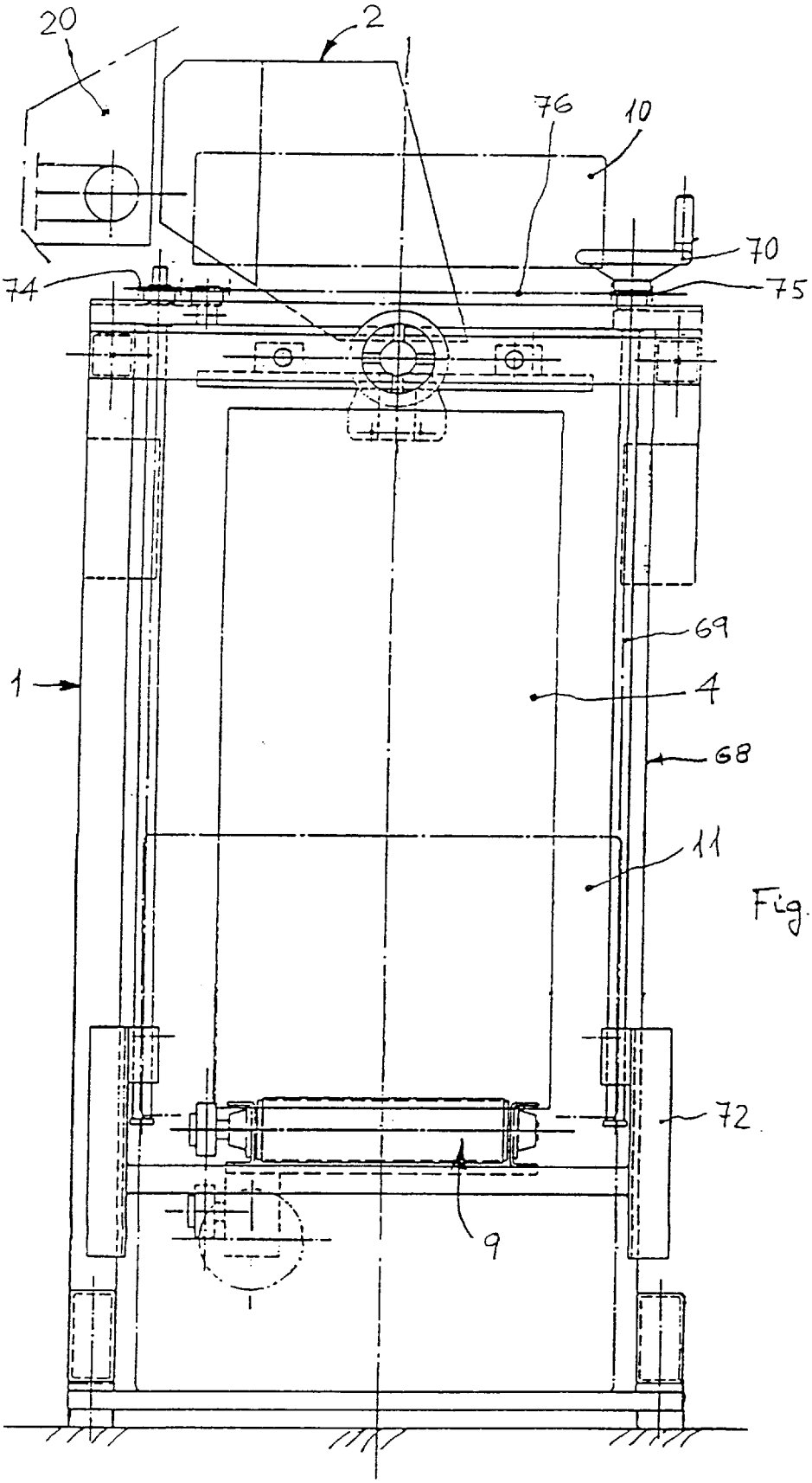
FIG. 2 shows a front view of the machine of FIG. 1 as seen in the direction of arrow F.

The machine will also provide corresponding protective covers for the user of the same, means of command and regulation (10) (FIGS. 1 and 2), and electrical, electronic, and pneumatic means of connection and protection (11) (FIGS. 1 and 2).

Figure 5:
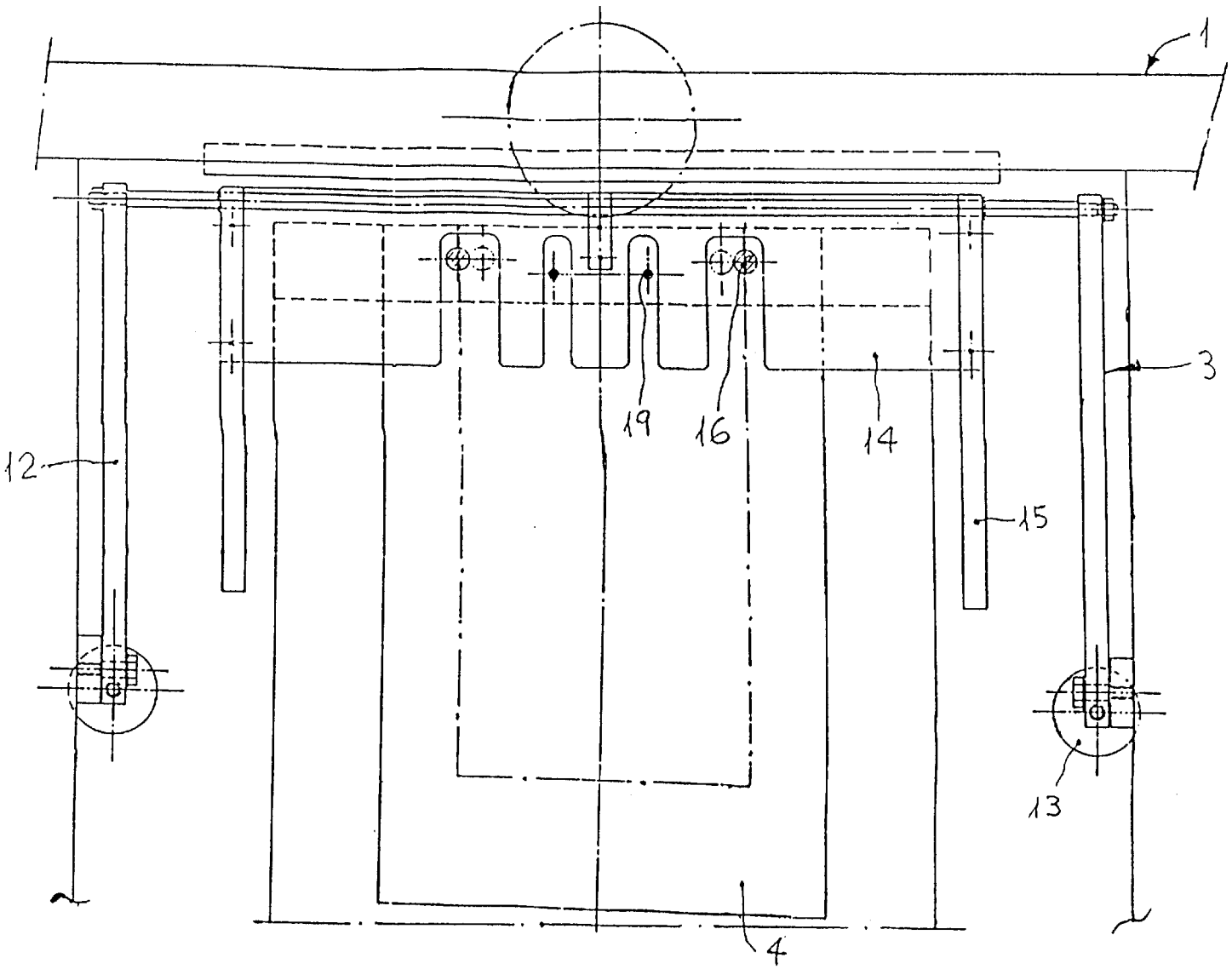
FIG. 5 is a front view of a temporary storage for the bags to be filled in a raised position.
Figure 6:
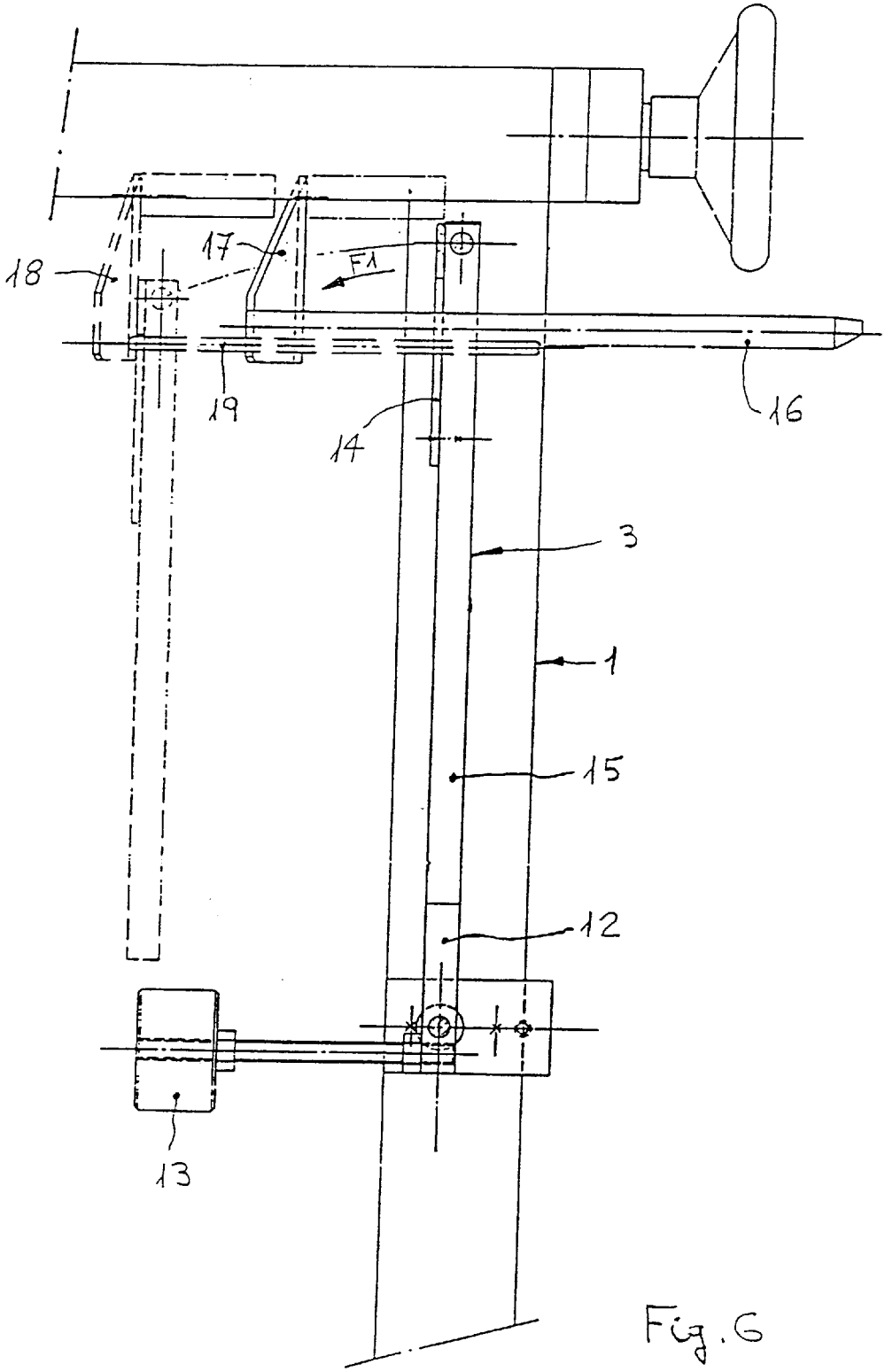
FIG. 6 is an enlarged left side view of the storage area of FIG. 5.

The means of temporary storage (3) of the bags (4) has an upside-down U-shaped frame (12) (FIGS. 5 and 6), is articulated by its lower points to the structure (1), and has two counterweights (13) which propel it in the direction indicated by the arrow (F1). In turn, said frame has a joined flange (14), with two arms as counterweight (15) which at the same time serve as a handle to place the bags while the machine is on. Said frame and flange press the set of previously hung bags on the pair of parallel horizontal rods (16) fixed at the rear end to the front fixed pincer (17), so that the set of hanging bags, by the two openings in said rods, remains wedged between said front fixed pincer (17) and the flange (14), by the action of said counterweights (13) and (15); all this is so that during the functioning of the machine the bags can be loaded into the temporary storage (3) means by only turning the set of the flange (14) and its two counterweights (15), toward the front part of the machine, overcoming the action of the counterweights (15). As can be seen in FIG. 5, the flange (14) shows the corresponding cuts for the passage of the rods (16). FIG. 6 shows the fixed pincer (18) with the two rods (19) (also visible in FIG. 5); said pincer and rods being of smaller dimensions than those corresponding to pincer (17) and its rods (16), which corresponds to a possible adaptation of the means of temporary storage to bags of lesser dimension and which present openings of smaller diameter; it should be noted that since such bags also have a smaller mouth diameter, it is necessary to move the fixed pincer (18) toward the exit of the machine as shown by the strokes in FIG. 6.

Figure 3:
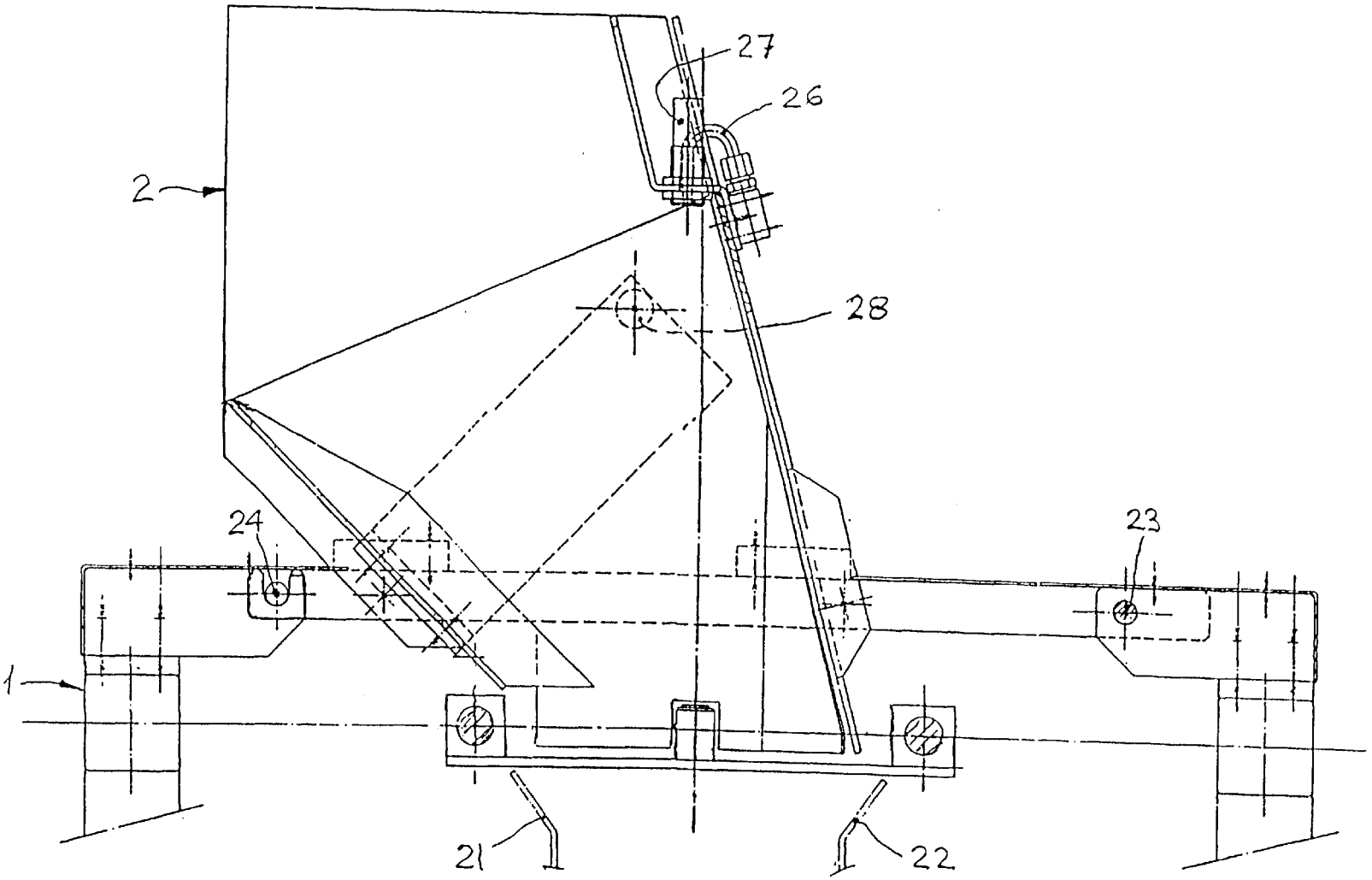
FIG. 3 is a front, enlarged view of a detail of the machine's chute in a raised position.

The chute (2) receives the product to be packaged in the corresponding bags from, for example, a weighing machine (20) (represented in sketch form in the final part of transporting the product toward the exit of the machine), and drives the product downward, discharging it through the open mouth of the corresponding bag, as seen in FIG. 3, in schematic form, the upper parts of the left side pincer (21) and the right (22), respectively. The chute (2) (FIGS. 3 and 4) can be folded around the longitudinal lateral axis (23) so that it can be repelled toward the outside of the right side, in this example, of the machine, although it evidently could be folded toward the opposite side if desired, given the mounting represented in FIG. 4 which permits reversing the direction of the folding of the chute during the manufacture of the machine. The chute remains in operational position thanks to the support of stubs (24) which are introduced in corresponding positions fixed to the structure (1) of the machine; to these effects, the chute has fixed transverse parallel profiles (25) which are joined by one of their ends to the axis (23) and by the other to the stubs (24).

The chute presents on its right face a flange **(26*a*) which acts as a bumper for the product as it goes through the chute, as well as a means of blowing (26) to assure the opening of the bag placed under and between the pincers (17), (21), (22), and another rear one which will be described further on, as well as a detector (27) to control the eventual formation of bridges of blockage of the product in the medium and/or lower part of the chute, producing a signal which would stop the feeding of the product from the weighing machine (20). For the handling of the chute, to fold it or return it to its operating position, there is a handle (28) and said chute allows for variation in its dimension in a lengthwise direction, that is, in the direction corresponding to the arrow (F2), but in both directions and always maintaining the center (0) in fixed position through which the vertical geometric axis of the shape bound by the pincers of the opening securing means of the bags, which will be referred to further on, passes. Said arrow (F2) of FIG. 4 indicates the direction of movement of the bags to be placed under the chute (2)** to thus be filled with the desired product.

The lower means of transportation of the bags (FIGS. 1 and 2 and, especially, 14 through 16) has a continuous belt (29) which is driven and supported at its ends by corresponding rollers (30) and (31), the latter being activated through a corresponding transmission by an electromotor (32) with its corresponding reducer of speed. The upper part of the continuous belt (29) is guided and supported on a longitudinal plate (33), and the set of the lower means of transportation (9) is fixed to the structure of the machine by some means of regulation from its raised position. At its initial end, that is, next to the means of temporary storage (3), of said lower means of transportation (9), there is a vibrating medium having two parallel vertical L-shaped supports (34), which are fixed to the transportation means (9) and which are joined to a vibrating platform (35) by virtue of its attachment by means of two levers (36) which form a hinged quadrilateral, by which two of its ends are attached to a vertical extension of the platform (35), and by which its other two ends are joined to the supports (34), and the lower lever (36) has a fixed vertical flange (37). This vertical flange (37) is joined at one end to the trunk of the cylinder (39), represented in sketch form in FIG. 15, whose opposite end of its body is joined between said supports (34) by the axis (40), such that the cylinder acts in pulsating form when activated, producing a vibration in the platform (35) on which the bag (4) is supported when it is being filled or has just been filled with the corresponding product, showing in FIGS. 1, 14, and 15 the direction of circulation of the upper part of the continuous belt (29) with the arrow (F3).

Figure 7:
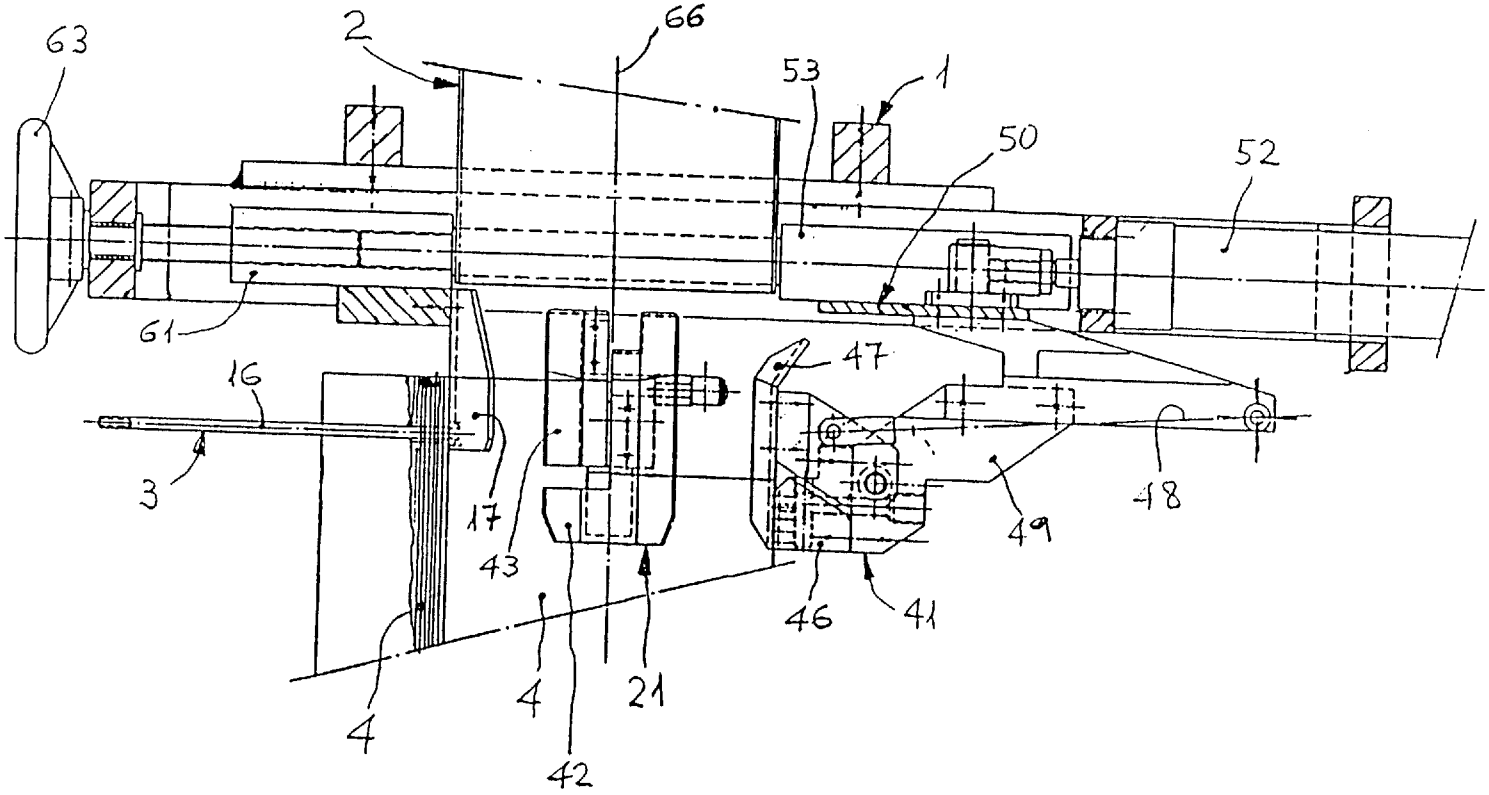
FIG. 7 is a right side view of means for opening and securing the mouth of the bag in a raised position.
Figure 8:
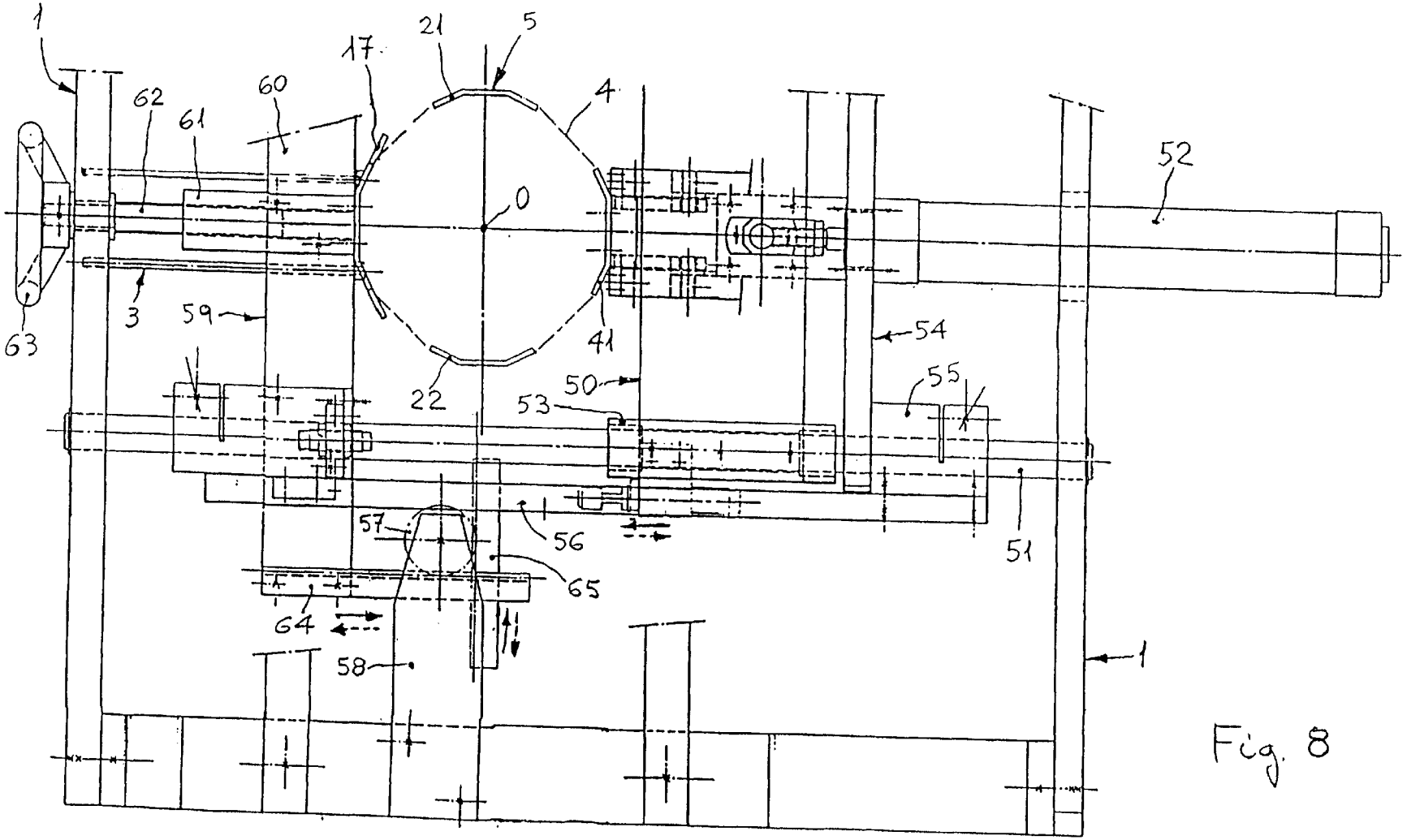
FIG. 8 is a partial plan view of the means for opening and securing of FIG. 7.
Figure 9:
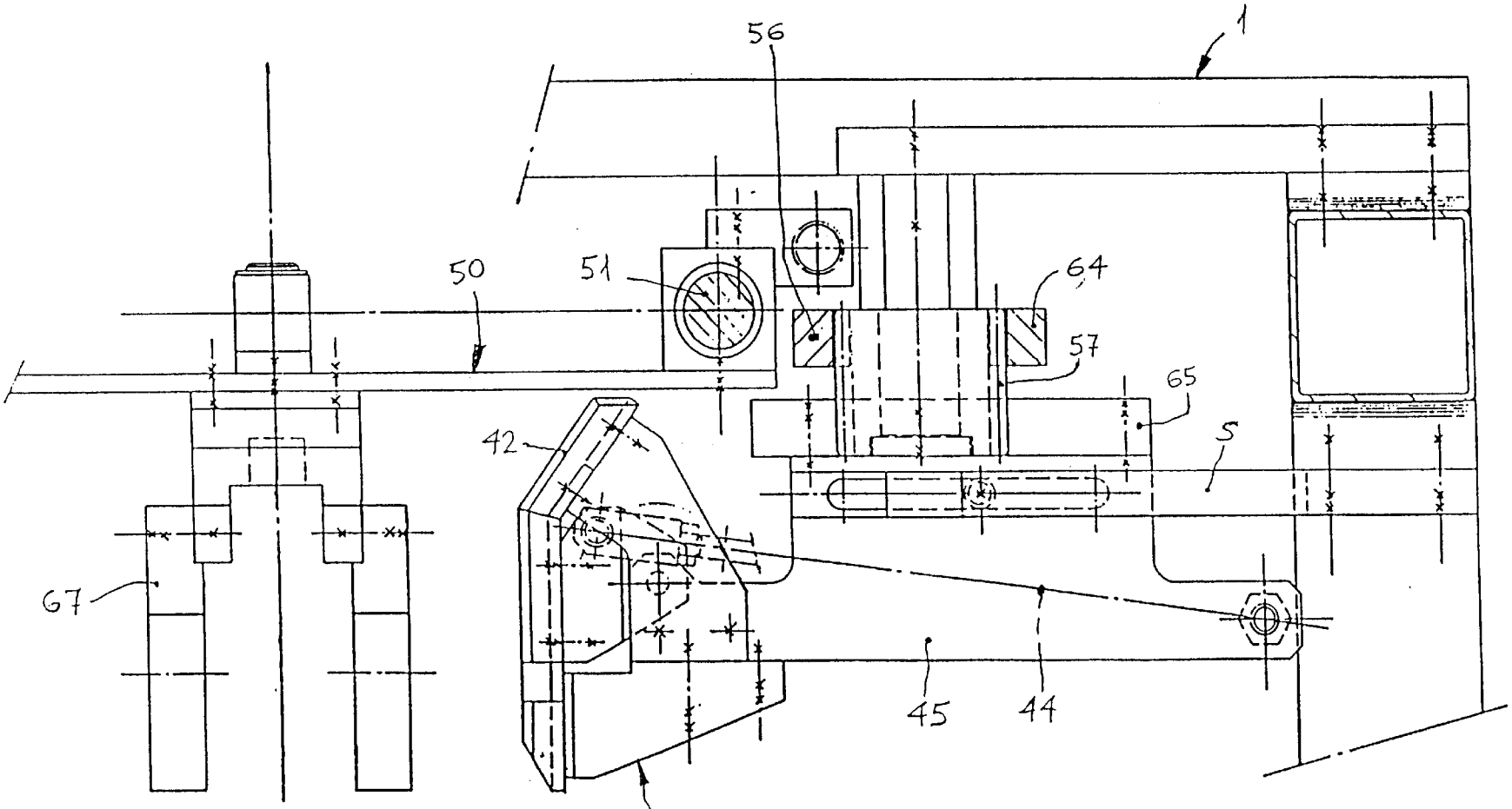
FIG. 9 is a partial transverse enlarged plan view of the means for opening and securing of FIGS. 7 and 8.

In FIGS. 7, 8, and 9, the front fixed pincer can be observed. This front fixed pincer has previously been described with regard to the means of temporary storage (3) of the bags (4), the left (21) and right (22) side pincers and the rear pincer (41). In sum, the opening and securing means of the mouth of the bag (4) has two pairs of pincers (17) and (41), and (21) and (22), the pincers of each pair being placed opposite one another and the central longitudinal plane of the machine coinciding with the central vertical plane of the pair of pincers (17) and (41), the other pair of pincers (21) and (22) being on a vertical central plane perpendicular to the previous one.

Figure 10:
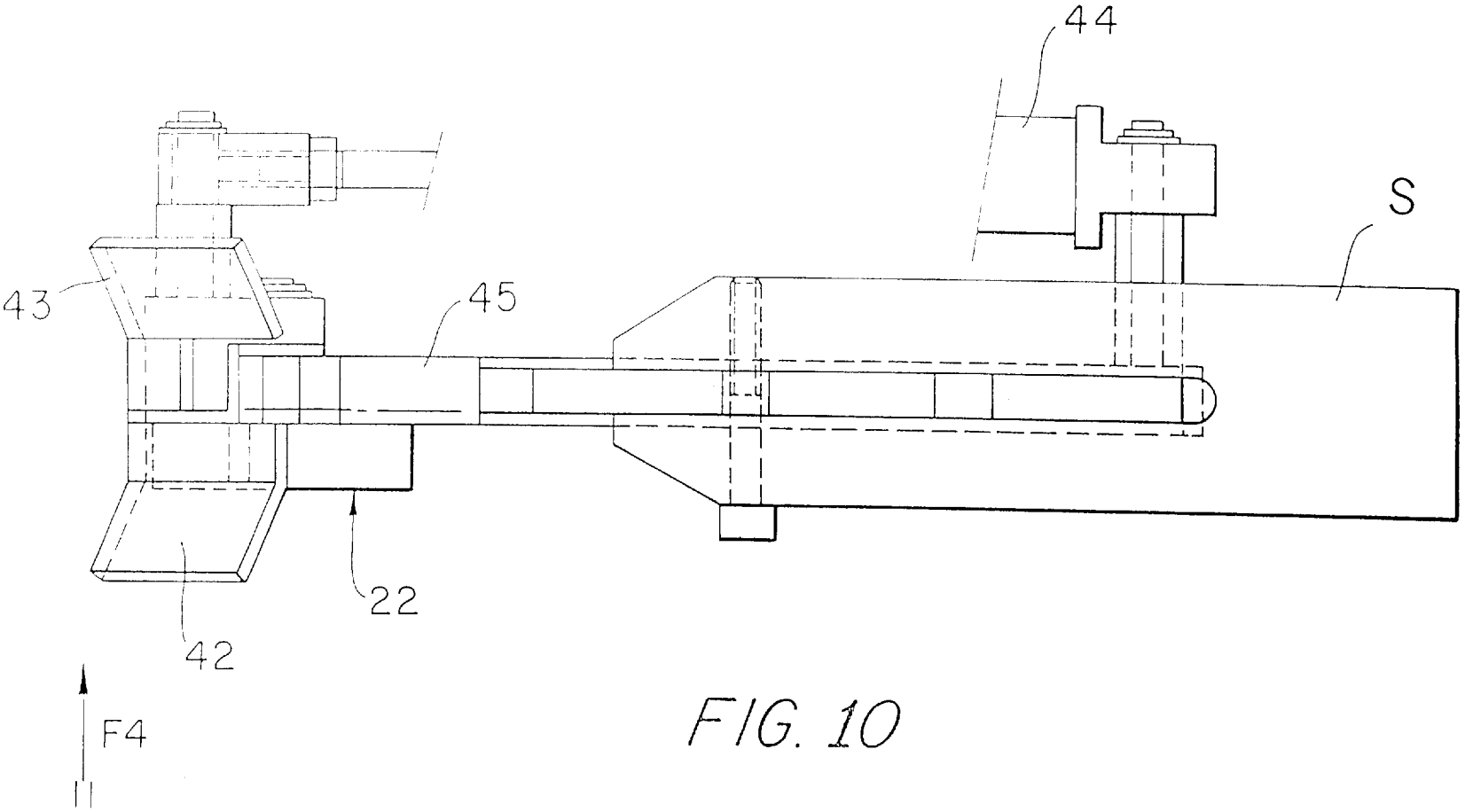
FIG. 10 is a plan view of a detail from FIG. 9.

The front fixed pincer (17) has a vertical flange with two oblique flaps diverging toward the rear pincer (41). The two side pincers, left (21) and right (22), are equal and symmetrical, and its description will be apparent in FIGS. 9 and 10, in which it can be seen that the side pincer (22) has a fixed part (42) and a rotating part (43), which is activated by a pneumatic cylinder (44) which is joined at one end of its trunk to said rotating part and by the other end of its body to the support (45) which joins the fixed part (42). The right side pincer (22) (FIGS. 9 and 10)—and the same will occur symmetrically with the left side pincer (21)—can be moved transversely, since the support (45) is placed in sliding position on a support (S), fixed to the structure of the machine. The arrow (F4) of FIG. 10 only represents the general direction of the bags in the packaging machine. The rear pincer (41) (FIG. 7) also has a fixed part (46) and a rotating part (47) which is activated by means of a pneumatic cylinder (48) (represented in sketch form), one end of its trunk joining said rotating part and the opposite end of its body joining the support (49) which is attached to said fixed part (46), which has some openings positioned toward the front part of the machine and connected to a vacuum source (for example, by the Venturi effect, in order to use the network of pressured air which feeds the machine's pneumatic cylinders). These openings produce an intake of air at a given moment, which will be explained in the part about the functioning of the machine. The support (49), in turn, is guided in the same way as a car (50) (FIGS. 7, 8, and 9), supported and in turn guided by the respective bars (51) (only one of the two bars is shown in FIG. 8—the one corresponding to the right side of the machine—, but the left side of the machine is equal and symmetrical); and said support (49), and because of this, the rear pincer (41) can move along a relatively long trajectory by means of the pneumatic cylinder (52) in order that the rear pincer (41) may move (toward the left according to FIG. 7) until its fixed part (the rotating part is rotated upward and back) is placed on the first bag of the means of temporary storage (3) of the bags, that is, the bag from said storage whose rim is in direct contact with the front side of the front fixed pincer (17).

The car (50) has a transverse handrail joined to small handles such as small handle (53), there existing another symmetrical one on the left side of the machine and which facilitates its guidance along the bars (51). The pneumatic cylinder's (52) body is joined to the car (54) which rests on and is guided along the bar (51) by a clamping device (55), and the bar and the symmetrical clamping device on the left side (not shown) being convenient such that the clamping device has a means of fixing into position, once the position of the car (54) has been regulated—as will be explained further on—and each of the two clamping devices has a longitudinal rack which is coupled to the idler (57), suspended rotationally on a vertical axis joined to the horizontal support (58), which in turn is joined to the structure (1) of the machine. The latter has another car (59) which has a transverse handrail (60) whose central part is joined to a small handle (61) screwed on from the inside and threaded by a lengthwise lead screw (62), which is supported on the structure (1) and can rotate without moving along the axis, and the front end of the lead screw is joined to a flywheel (63) whose activation by the user of the machine moves the screw on the small handle (61), and therefore moves the car (59), which has a longitudinal rack (64), parallel to the rack (56) at each end, so that the movement of said rack (64) makes the idler (57) rotate in one direction or another, which, in turn, makes the longitudinal rack (56) move in the opposite direction to the movement of the rack (64), and, at the same time, produces a transverse movement of the transverse rack (65), perpendicular to racks (56) and (64), joined to the right side pincer (22) (and the same will occur symmetrically with respect to the left side pincer (21) with its corresponding rack, idler, and the two aforementioned racks).

Figure 4:
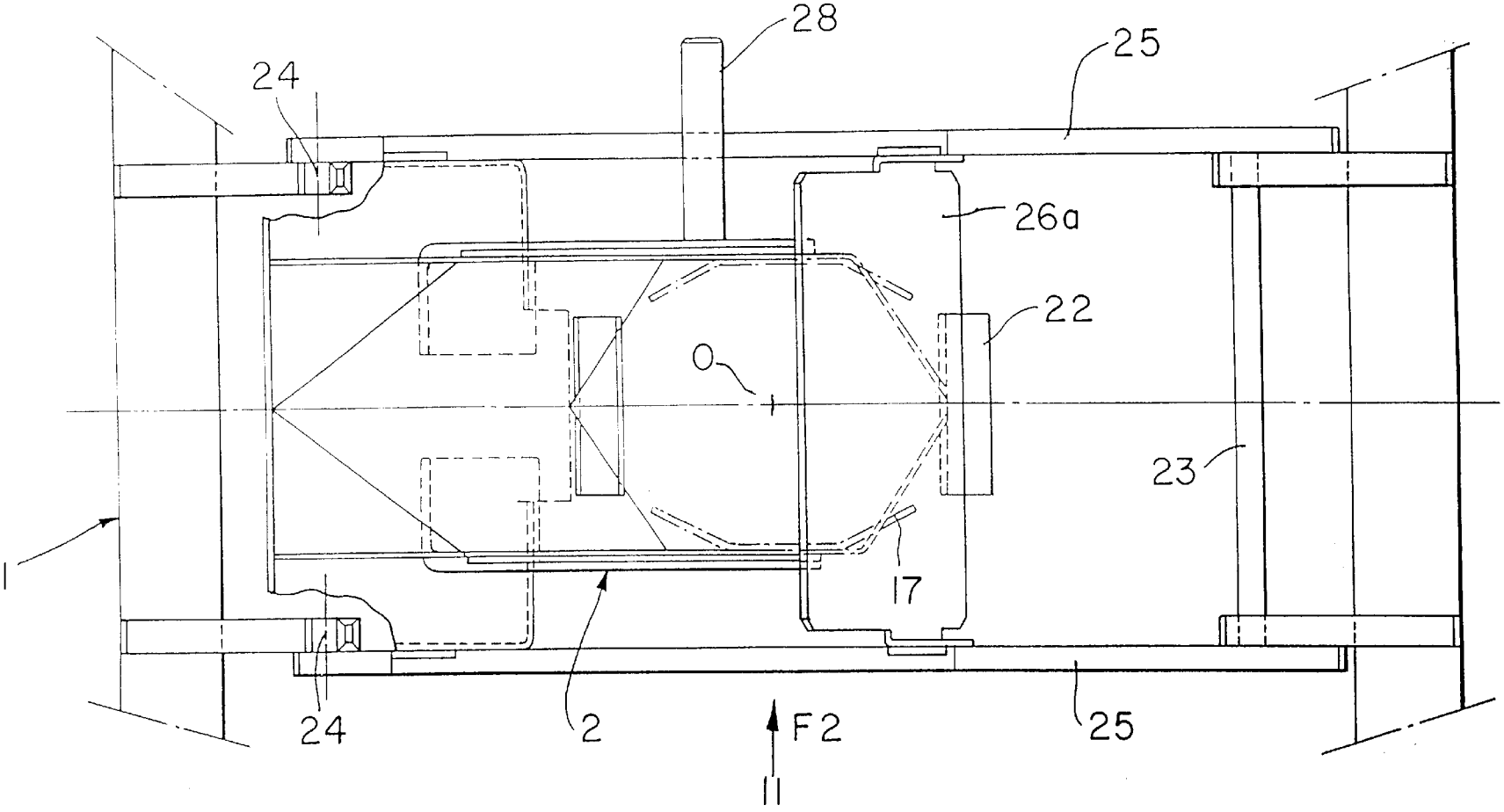
FIG. 4 is a plan view of FIG. 3.

In FIG. 8, continuous line arrows and strokes show the different directions of the three racks (56), (64), and (65), with the corresponding movements of the side pincers (21) and (22) and the rear pincer (41) in synchronized and simultaneous form in terms of its distance or separation with respect to the central vertical geometric axis (66) (FIG. 7) and which passes through the center (0) of FIGS. 4 and 8, such axis being that of the octagonal contour which the mouth of the bag secured by the four pincers adopts, which flanges—fixed in terms of pincer (17) and rotational in an upward direction in terms of the two side pincers (21) and (22) and the rear pincer (41)—which remain vertically placed in their operational position and have two oblique flaps which diverge toward the opposite pincer, outlining in this fashion the octagonal shape, which is the one adopted by the mouth of the bag secured by the pincers in the operational phase corresponding to its filling with the product discharged from the machine's chute. It should be noted that only the rim of the bag is secured to the front pincer (17). In FIG. 9, support (67) of the rear pincer (41) which is joined to the car (50) can be seen.

The lower means of transportation (9) (FIGS. 1 and 2) can move at a certain height according to the length of the bags to be filled so that the base of each bag which is transported rests on the upper part of the continuous belt (29). For this, the means of height regulation (68) (FIGS. 1, 2, 12, and 13) consists, in this example, of a vertical lead screw (69) guided in the structure (1) and whose upper end is joined to a flywheel with an activating tube (70), and in the lead screw there is a small handle screwed on from the inside (71) coupled to it, and it being convenient that said small handle has a means of remaining in the desired position, once this is achieved; this small handle is joined to a means of guidance (72) which is encircling a vertical rail (73), fixed by its upper and lower ends to the structure of the machine, these means and mechanisms described being placed in the right side of the machine being placed, while on the left side there is a setting symmetrical to the one before, but with the difference that the upper end of the lead screw is joined to one cog wheel (74) which is linked to another cog wheel (75) joined to the lead screw (69) by a chain (76) (FIGS. 2 and 12), with interposition of an adjusting wheel (77) in said chain.

The upper means of transportation (6) (FIGS. 11 through 13) has an elongated left horizontal platform (78) and a similar right one (79) (see FIG. 12) equal and symmetrical with respect to the circulation of the bags, indicated by arrow (F5); the upper left means of transportation will be described further on. At each end of the platform (78) there are pulleys, pulley (80) being greater and pulley (81) being smaller; between these there is a continuous belt (82), the platform also having some small loose pulleys (83) on the side which will face opposite the right platform for the correct support and guidance of the belt which circulates on this side.

The platform (78) can rotate around a vertical geometric axis (84), which is the vertical axis of the pulley (80), thanks to two small handles (85) (FIG. 13) which are joined around a vertical tube (86) fixed to the structure (1) of the machine and which are joined to said platform (78) by the corresponding flange. Platform (78) is rotated by means of a pneumatic cylinder (87) (FIGS. 11 and 12), whose trunk joins by one free end to said platform (78) and whose body joins the structure (1) of the machine. All that which is highlighted in terms of making up the upper left means of transportation is of symmetrical application to the upper right means of transportation; it should be noted that FIG. 12 shows the left platform in open or non-operational position and platform (79) in its operational position, that is, that both are together, and between them the corresponding bag can be driven in the direction indicated by the arrow (F5).

The rotational functioning of the pulley (80) is enabled by a vertical axis joined to said pulley which goes through the inside of the vertical tube (86) (tube might not exist and be just the particular axis), and the upper end of said axis is joined to a cog wheel (88) in turn working off another cog wheel (89) so as to enable the rotation of the other major pulley of the platform (79), both pulleys rotating in opposite directions so as to achieve a match with regard to the direction of circulation of the corresponding belts on its sides facing the operational position of the platforms (78) and (79); and the cog wheel (89) is, in turn, geared to another cog wheel (90), joined to the reducer from an electromotor (not shown).

Figure 11:
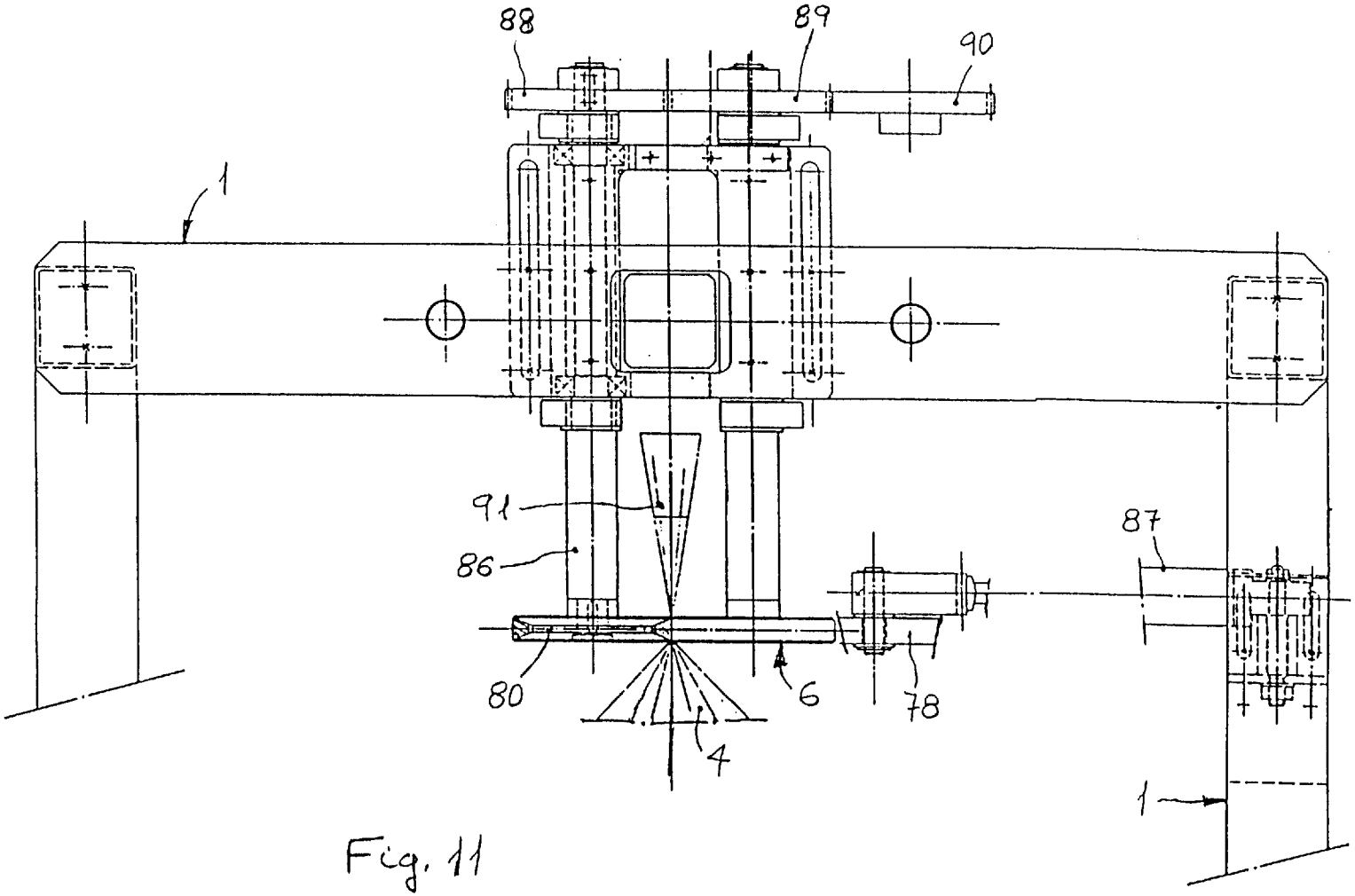
FIG. 11 is a front view of the rear of an upper means of transportation of the bags in a raised position.
Figure 12:
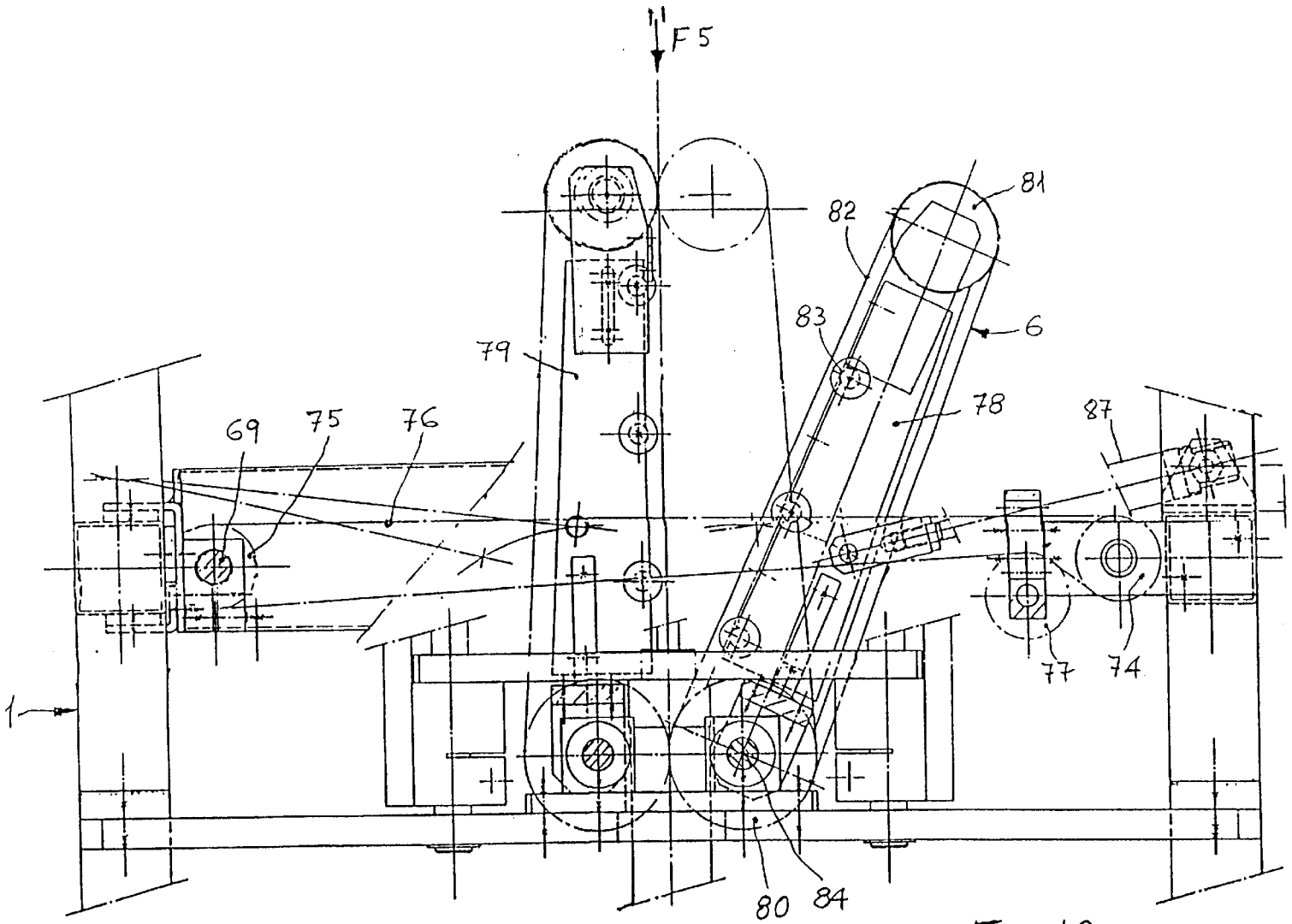
FIG. 12 is a plan view of the means of transportation of FIG. 11.
Figure 13:
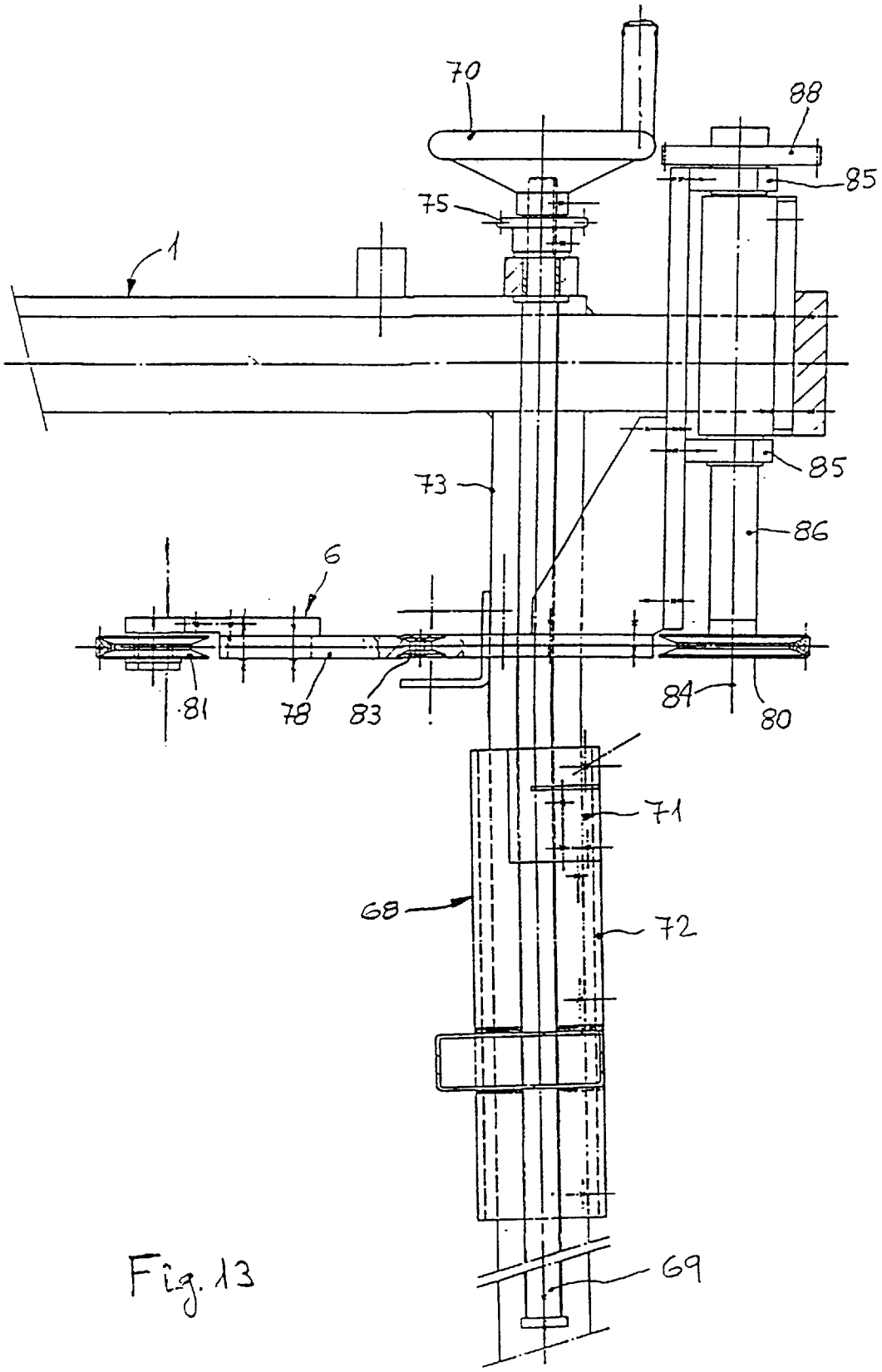
FIG. 13 is an enlarged view of the raised right side of the means of transportation also showing part of the means of regulating the height of the lower means of transportation of the bags of FIG. 12.
Figure 14:
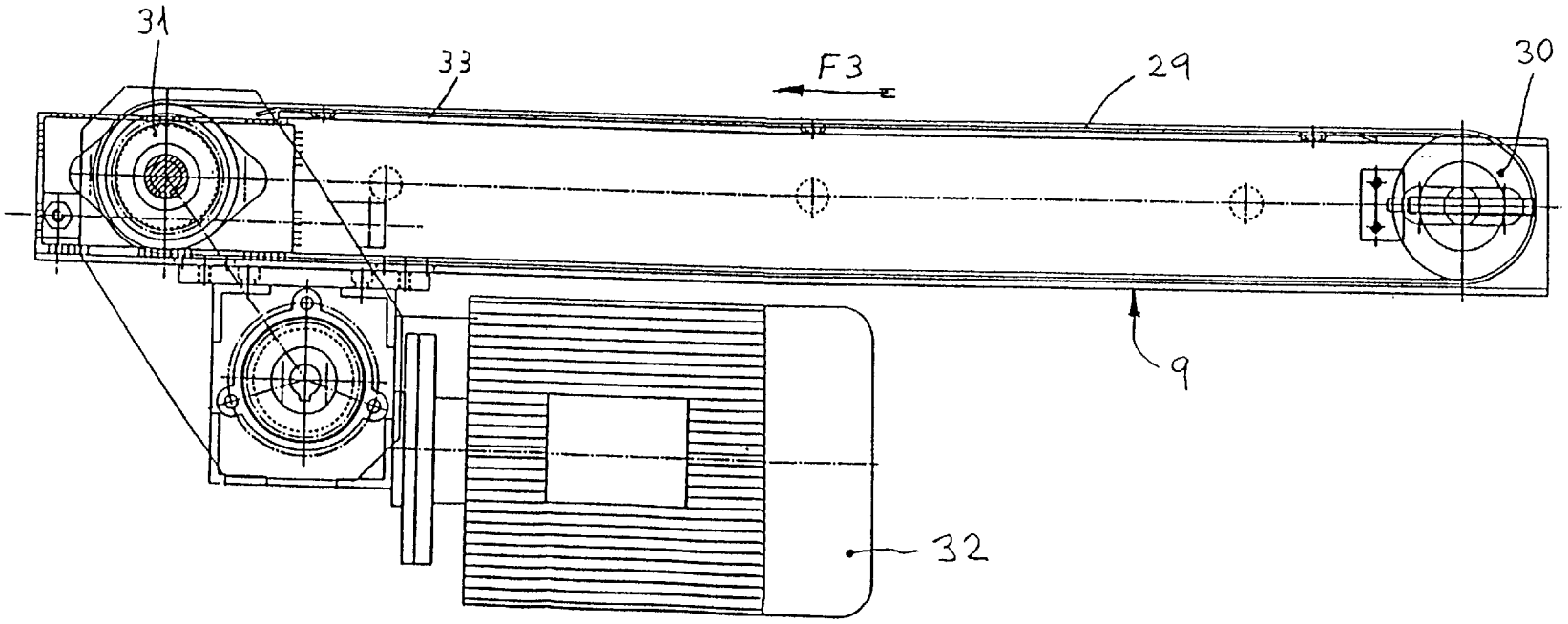
FIG. 14 is a left side view of the lower means of transportation in a raised position.
Figure 15:
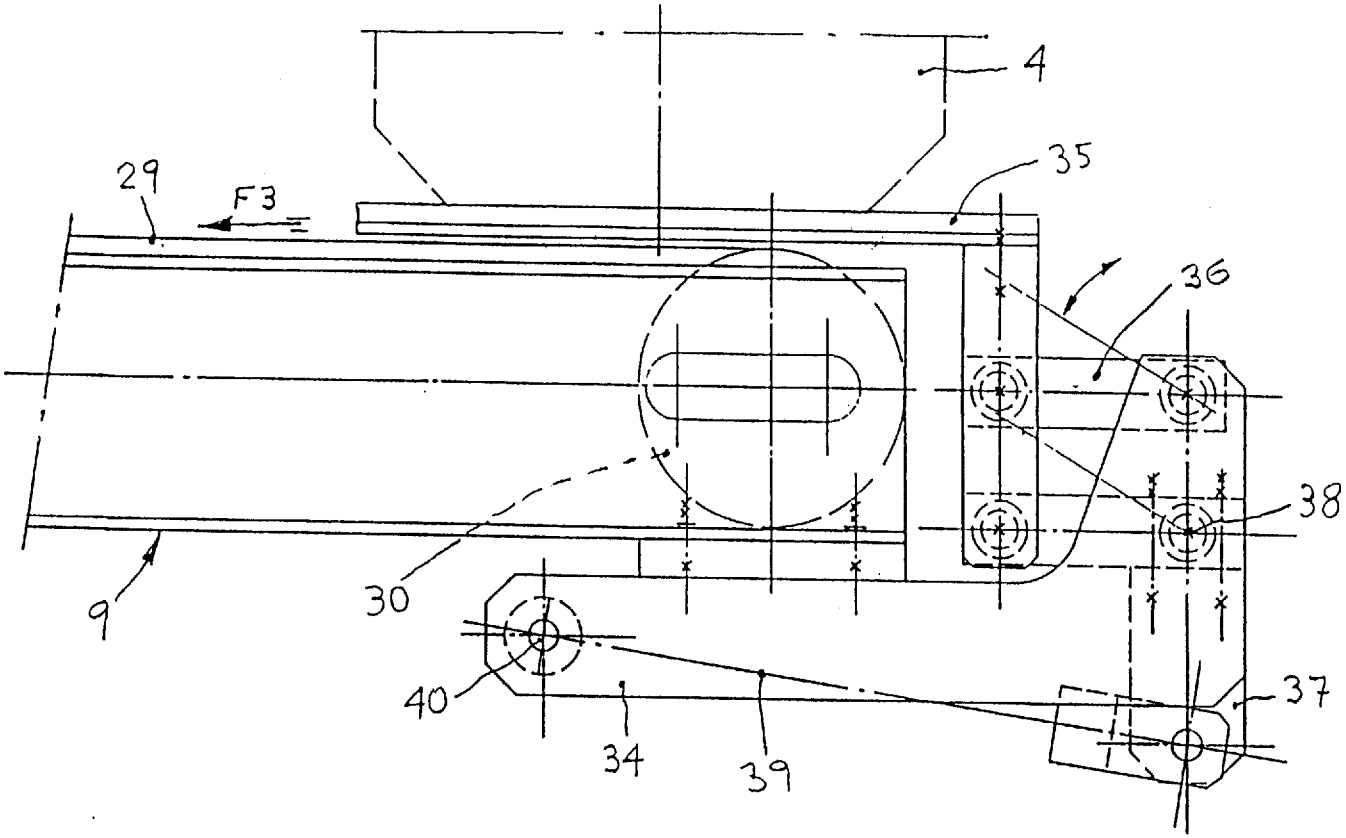
FIG. 15 is an enlarged view of a vibrating means connected to the lower means of transportation.
Figure 16:
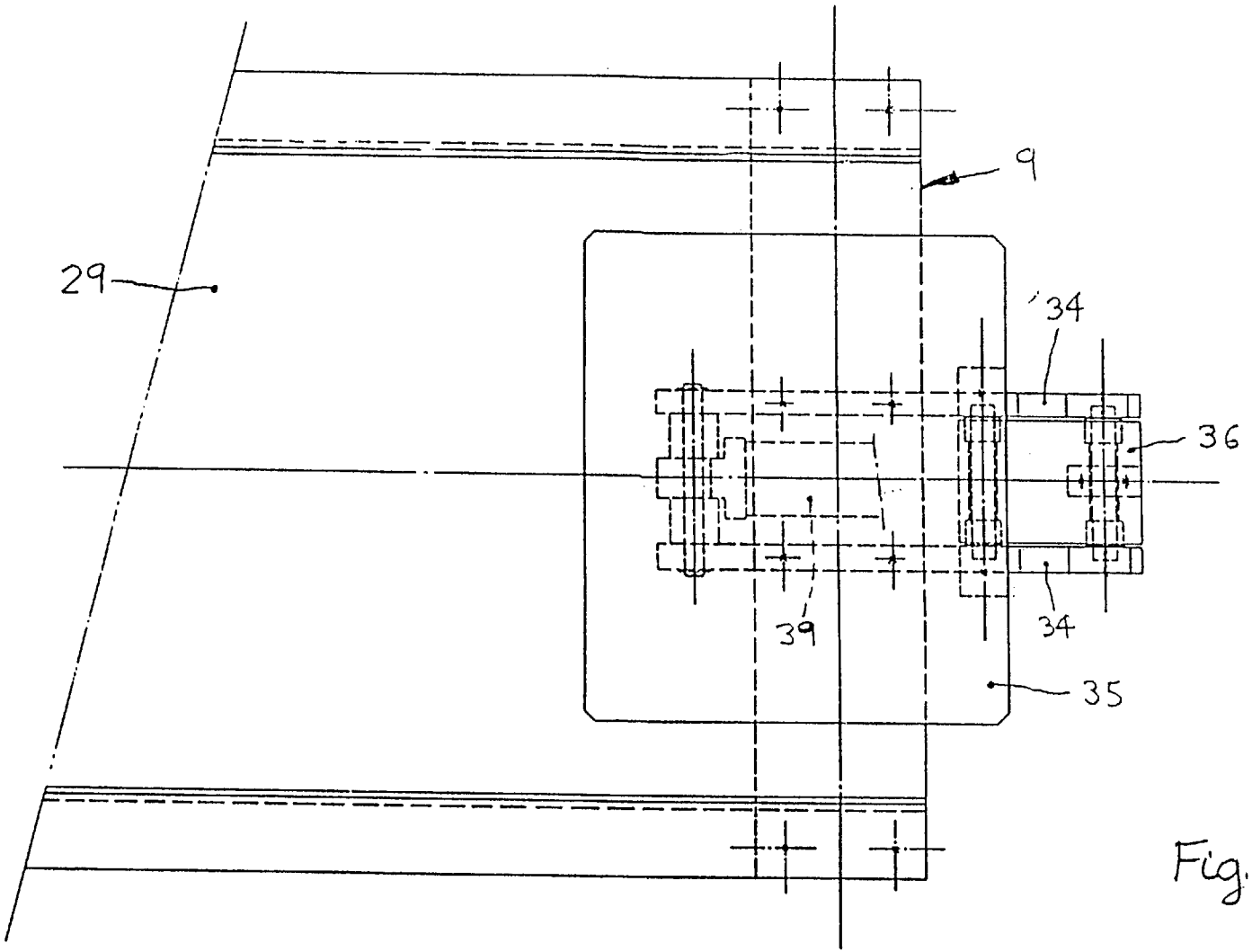
FIG. 16 is a plan view of the vibrating means of FIG. 15.

FIG. 11 shows the bag (4) which is driven by means of transportation (6) described, showing the upper part (91) of said bag which is on top of said upper means of transportation (6). The upper means of transportation (6) could have in each of its two platforms a rod lengthwise to each platform for better guidance of the bag which is transported, as well as some means of blowing in the rear part, that is, next to the major pulley of each platform to impel the upper part of the bag and assure a further operation of pinching, blowing which is effected by means of pressured air from the machine (said rods and the described means of blowing are not shown).

Figure 17:
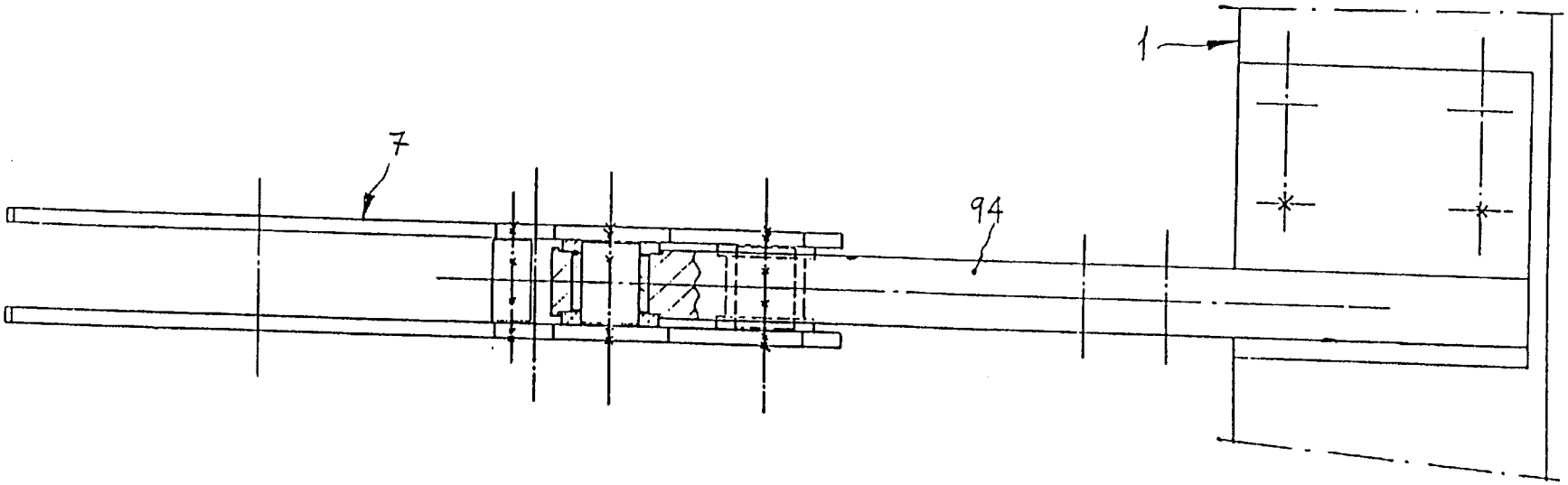
FIG. 17 is a front view of the rear of a gathering means of the present invention in a raised position.
Figure 18:
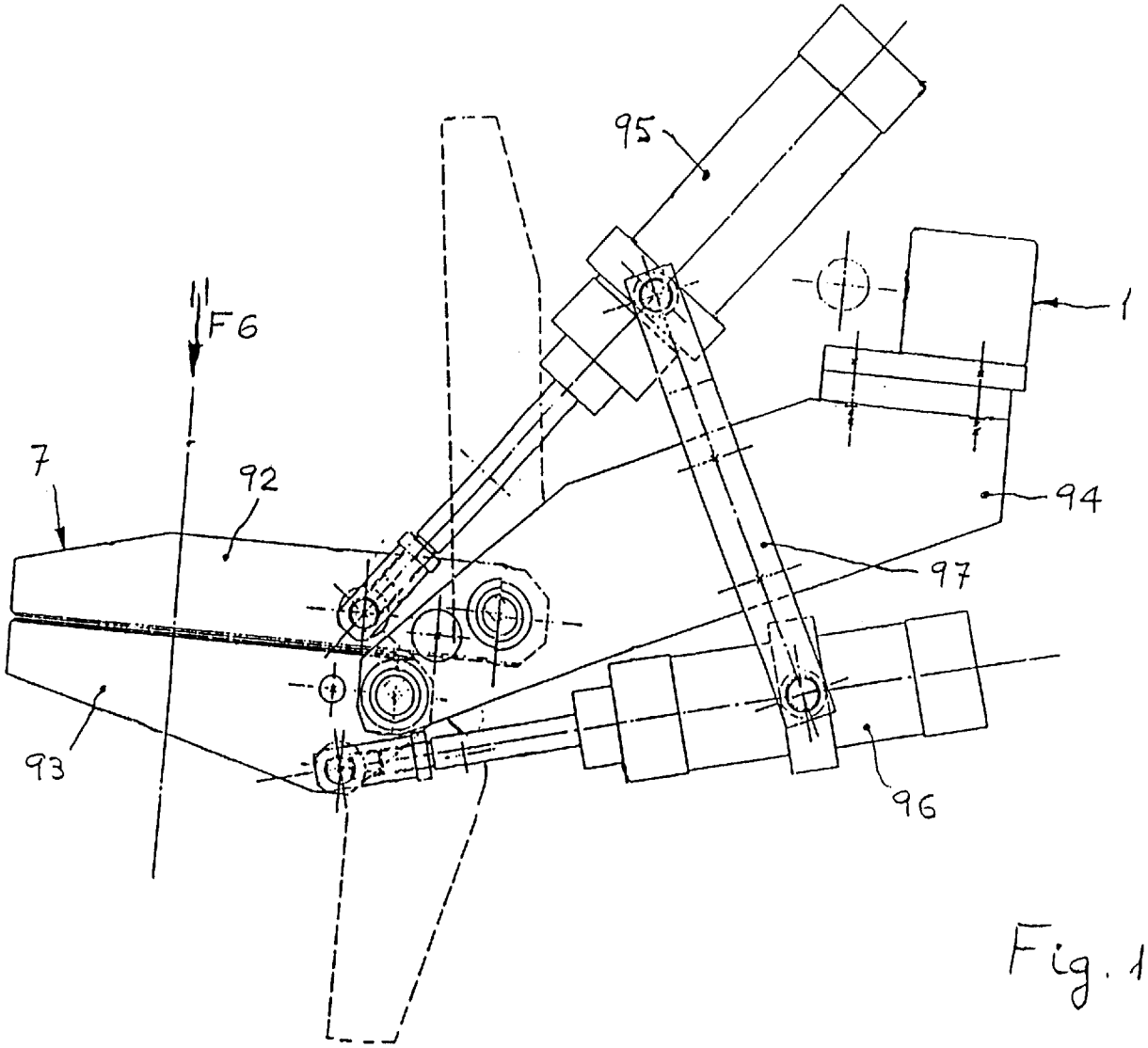
FIG. 18 is a reduced size plan view of the gathering means of FIG. 17.

The gathering means (7) of the upper part of each bag (FIGS. 17 and 18) which moves in the direction of the arrow (F6) has the pair of front blades (92) and the pair of rear blades (93) which are horizontal; each pair of blades (94) has two superimposed and parallel blades as can be seen in FIG. 17, each pair of blades being joined to a horizontal support (94) joined to the structure (1) of the machine. To obtain the rotation on a horizontal plane of both pairs of blades, there are pneumatic cylinders (95) and (96), whose bodies are joined to the sheet billet (97) secured to the support (94), and the ends of the trunks of said cylinders are joined to the respective pair of blades for their rotational flnctioning, the non-operational position of both pairs of blades being represented by strokes in FIG. 18.

Figure 19:
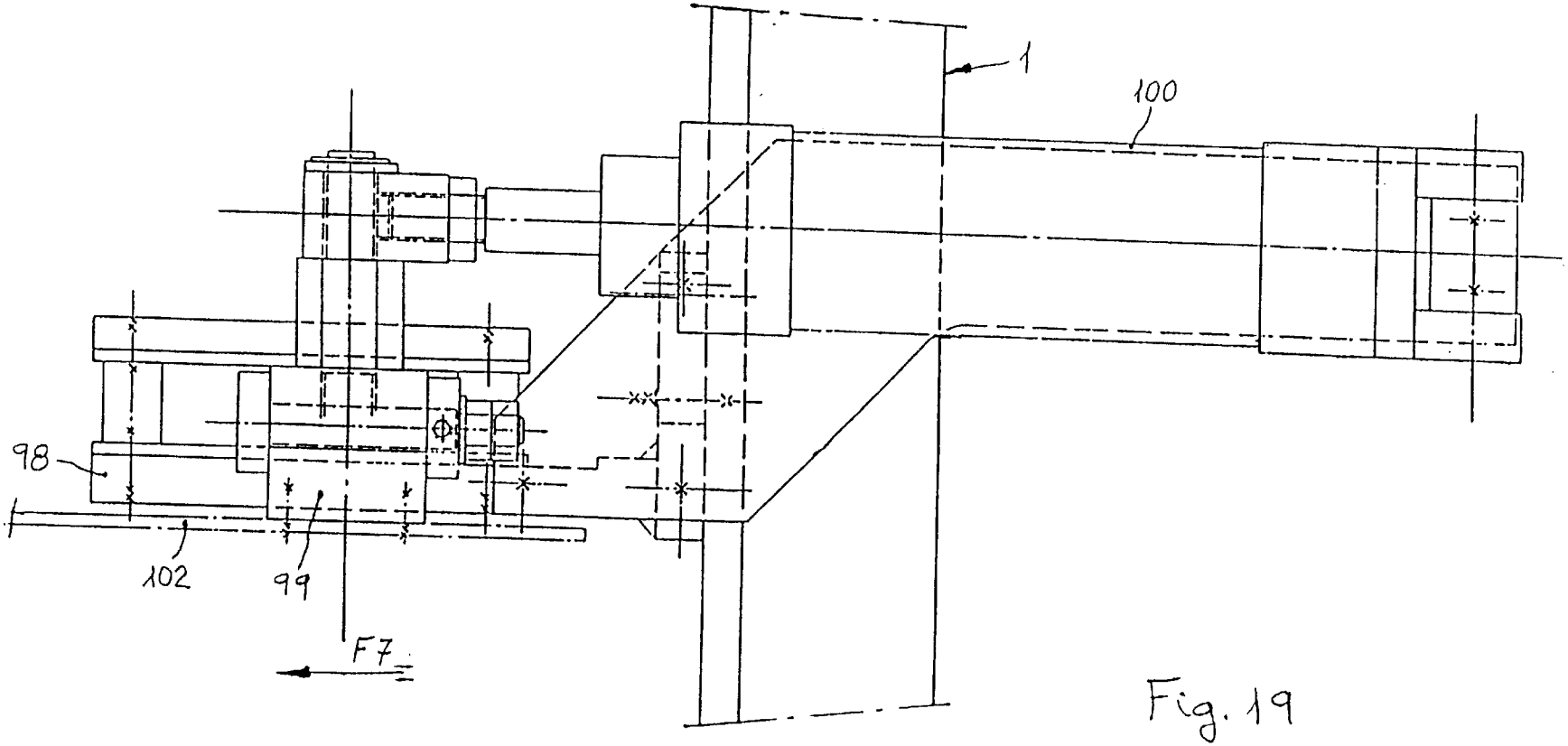
FIG. 19 is a left side view of functioning means of the closing mechanism in a raised position.
Figure 20:
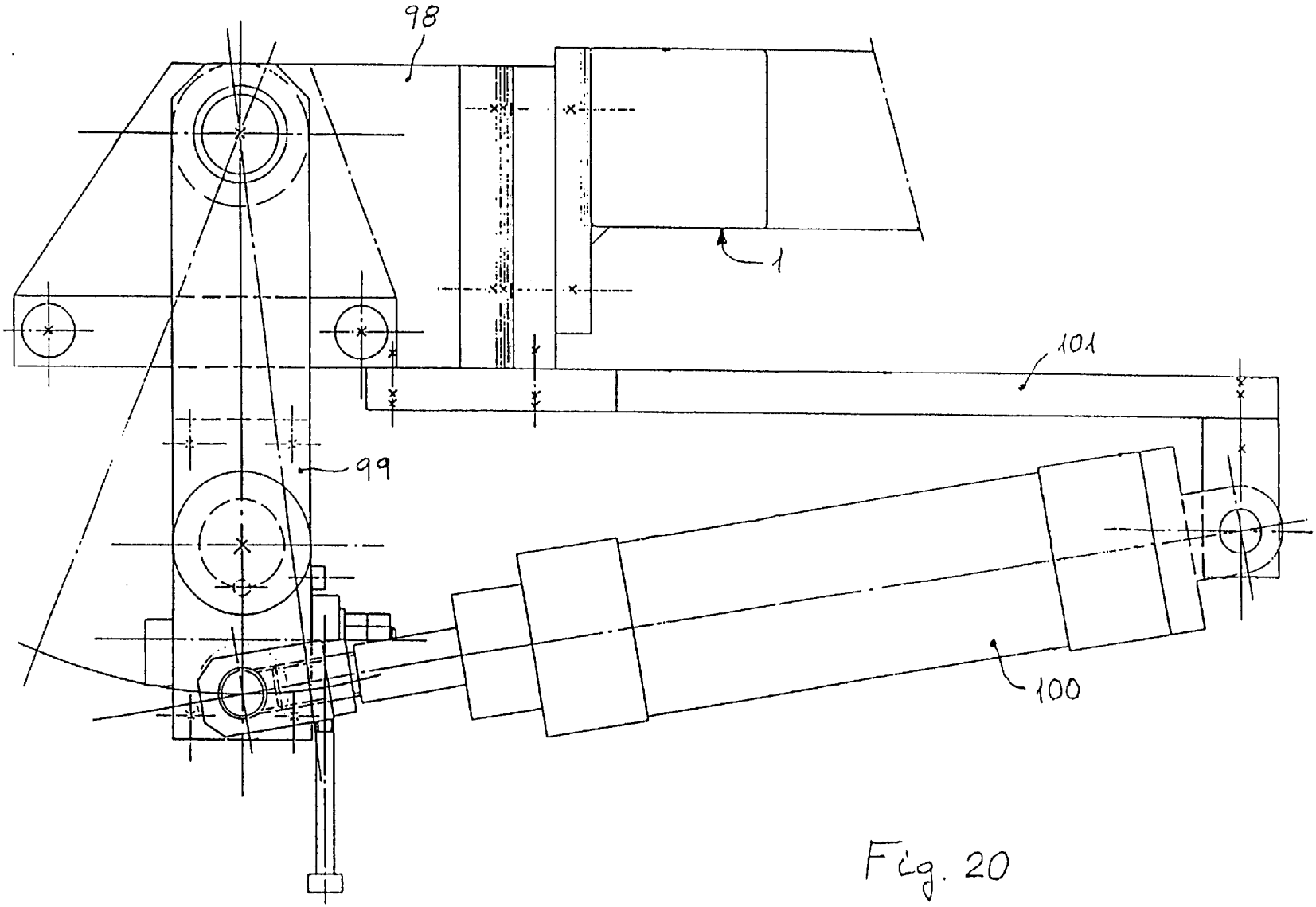
FIG. 20 is a plan view of the functioning means of FIG. 19.

In FIGS. 19 and 20, means of rotational functioning of the closing mechanism (8) of each bag, are shown. The means of functioning include a support (98) fixed to the structure (1) of the machine, which joins an arm (99) whose opposite end is joined to the end of the trunk of a pneumatic cylinder (100), whose body is joined by its opposite end to another support (101) joined to the structure (1). In FIG. 19, an arrow (F7) shows the direction of the circulation of the bags to be closed with the corresponding sealing tape in this example, represented by strokes and points on the upper horizontal flange (102) of the closing mechanism (8) which is joined to the lower part of the arm (99).

Figure 21:
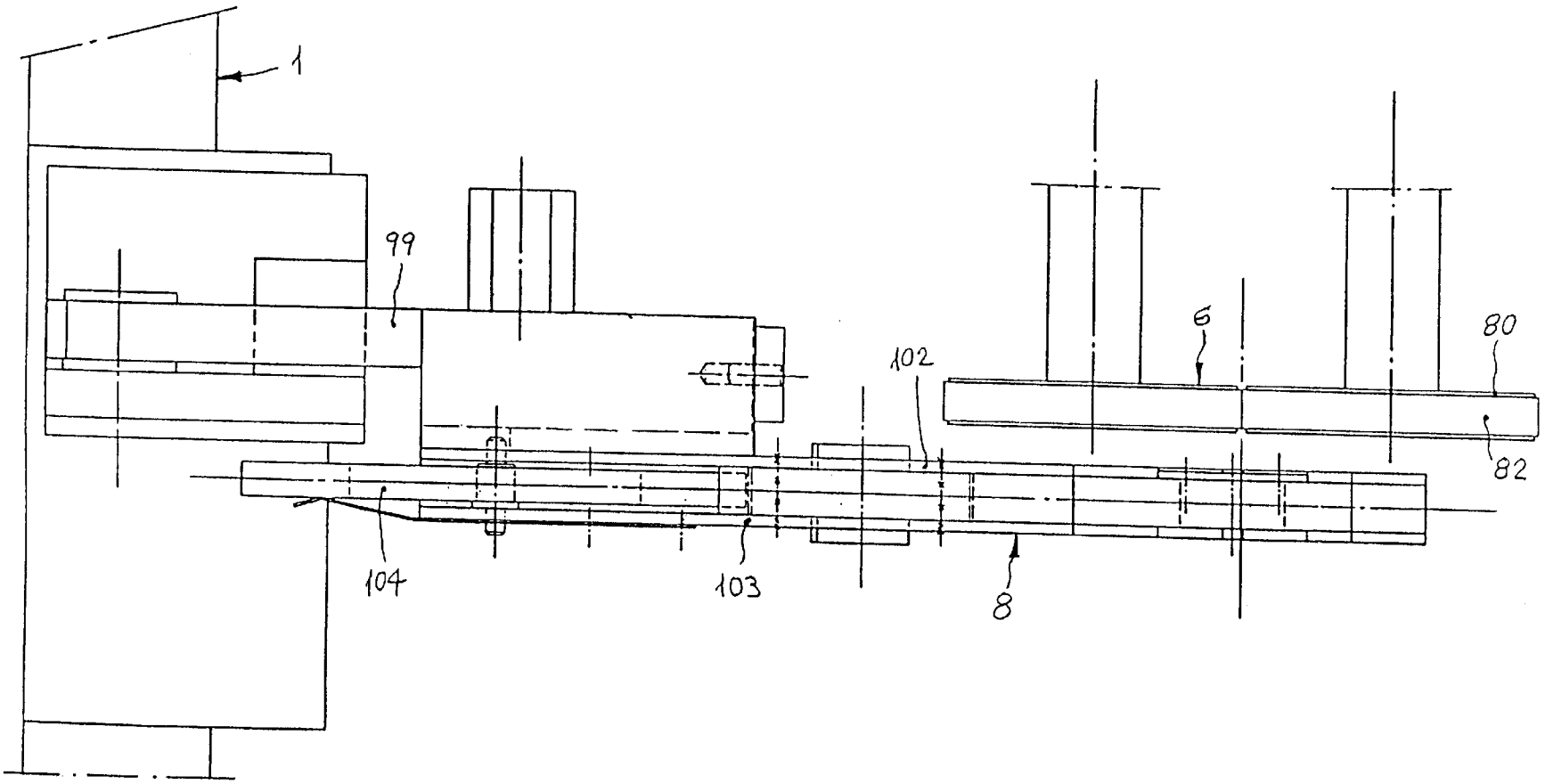
FIG. 21 is a front view of the rear of a closing mechanism in a raised position.
Figure 22:
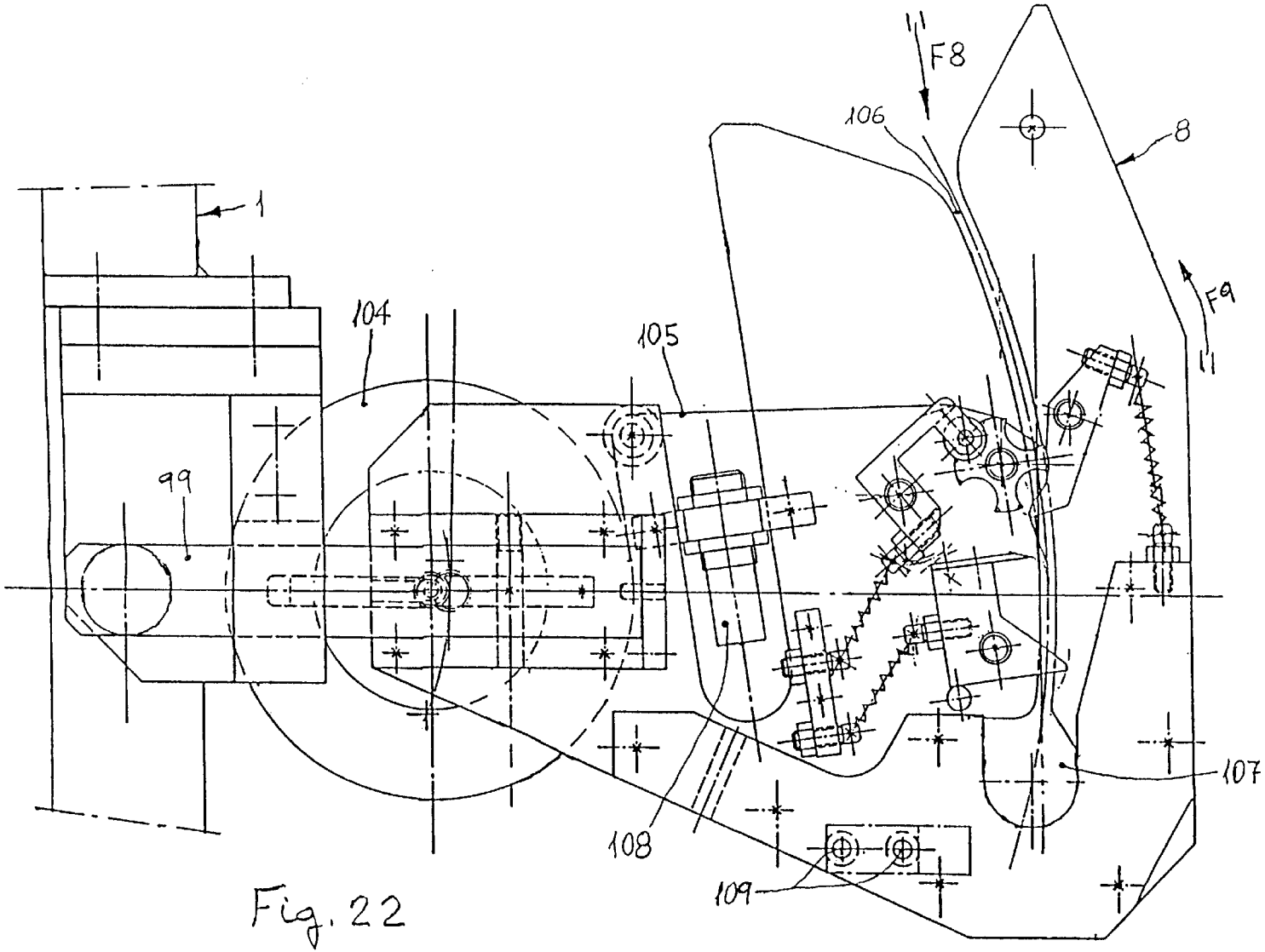
FIG. 22 is a plan view of the closing mechanism of FIG. 21.

The closing mechanism (8) of the bag is represented in FIGS. 21 and 22, showing in this latter one the arrow (F8)

which indicates the direction of circulation of the corresponding filled bag to be closed by sealing tape or the like. The closing mechanisms (8) of each already filled bag are, in and of themselves, conventional, and have two horizontal flanges, upper (102) and lower (103). The upper horizontal flange (102) corresponds to the flange represented in FIG. 19 and which is joined to the described means of functioning represented in FIGS. 19 and 20. FIG. 22 shows the functional part of said closing mechanism with sealing tape, with the bobbin (104) of the continuous belt (105) which is intermittently fed through the mechanisms shown in said FIG. 22, impelled by the introduction in the canal (106) of the neck of the corresponding bag closed by the tightening means (7), whose closing mechanisms move according to the arrow (F9) so that the neck of the bag arrives at the end (107) of said canal, the closing itself being accomplished by a sealing tape which has been previously cut to the necessary length. The angular turn in the direction of the arrow (F9) and its corresponding retreat, once the bag has been sealed, is accomplished by the functioning means described in connection with the previous FIGS. 19 and 20. There also exists a detector (108) of the presence of the sealing tape (105) which activates the corresponding stop if said sealing tape is not in front of it. The support mechanism for (110) (FIG. 28) for the cutting and temporary securing of the upper part of the bag, is fixed at the points of anchorage (109) (FIG. 22); this mechanism may or may not be included in the machine since it serves to eliminate the part of the bag over the seal placed previously, an option that can be chosen by the user of the machine. The means of cutting and temporary securing of the upper part of the filled and sealed bag are located at a level or height greater or above the closing mechanism (8) of the bag.

Figure 28:
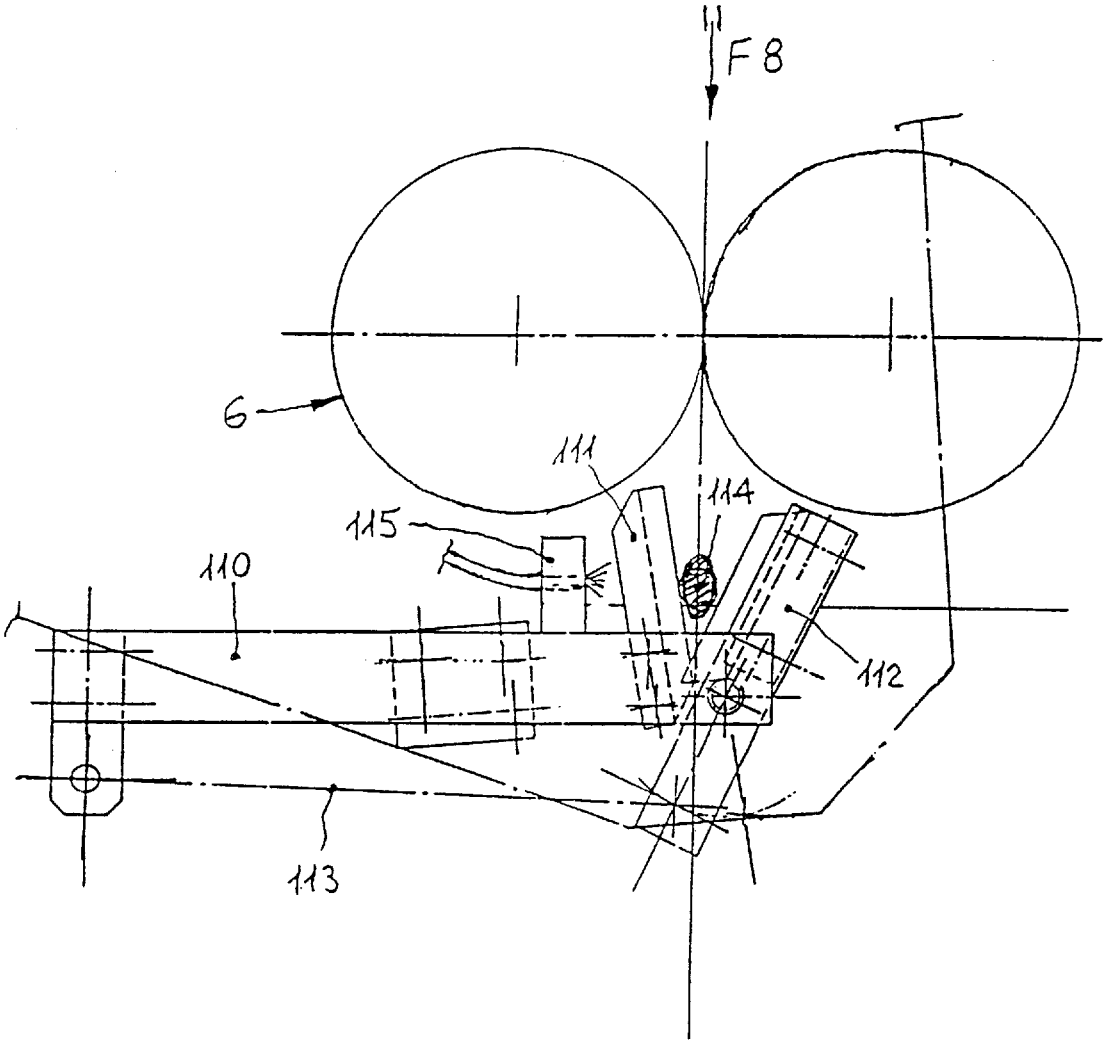
FIG. 28 is a plan view of a cutting and securing means.

Said support (110) has joined at one of its ends a semi-pincer collar tool (111) which is fixed and a semi-pincer cutter (112) with its knife facing the collar tool of the semi-pincer collar tool (111) and which is joined to the support (110), protruding from the support by the opposite part to that presented by the knife and whose protruding part is activated by the pneumatic cylinder (113) (represented in sketch form by a line of strokes and points), which, in turn, is joined to the support (110). FIG. 28 shows the closed neck (114) which corresponds to the part of the bag located over the sealing tape which closes it, so that the means of cutting and temporary securing of said upper part of the bag (already filled and closed with the corresponding sealing tape) are closed by the rotation of the semi-pincer cutter (112) until the knife is introduced in the canal of the collar tool of the semi-pincer collar tool (111), cutting said upper part at the level where said means of cutting and temporary securing are located and, at the same time, the parts acting as pincers in both semi-pincers secure a certain portion of the part located under the knife and within the range of the two semi-pincers; at the same time, the remaining top part of the upper part of the bag is also temporarily secured by the combined action of the two semi-pincers and whose functioning will be described further on with the description of the functioning of the machine. FIG. 28 also shows the means of blowing (115) which uses a source of pressured air from the machine, which action will be described in the description of the functioning of the machine.

FIGS. 23 through 27 show some means of securing and elevation of the upper part (91) of each of the bags which has a sheet billet (116) fixed to the structure (1) of the machine and which protrudes over and under it, so that its lower end joins the support (117), whose opposite end is joined, in turn, to the right semi-pincer (118) and the left semi-pincer (119), so that the semi-pincer (118) is joined to the axis (120) and the semi-pincer (119) is joined by the axis (121). Both pincers, in turn, are linked by a bi-flap (122) joined at its ends to both pincers according to FIGS. 24 and 26. The semi-pincer (118) protrudes behind the support (117) the end of this protruding part joining the end of the trunk of the pneumatic cylinder (123), whose body is joined by its opposite part to an extension of the support (117).

This last support is, in turn, linked by a fork joint (124) (FIGS. 23 and 25), which is joined to the trunk of the pneumatic cylinder (125) whose body is hinged by its opposite end, that is, the upper one in this case, this end also being above the sheet billet (116). Having shown in FIG. 25, in detail, the connection of the fork joint (124) to the support (117) and by the flange (126) fixed to the support, noting that the trunk of the cylinder (125) is joined by one free end to a bar (127) which can move along in an opening which has a fork joint (124), and the bar (127) has a lower part that is screwed on in which two nuts (128) are screwed in, so that the lower one carries out the function of the checknut to assure the positioning of the upper one, and between the latter and the base of the fork joint there is an elastic spring (129). This set of elements gives way to a certain effect of elastic suspension and stabilization of the support (117) with said means of securing and elevation and including the filled bag.

Figure 23:
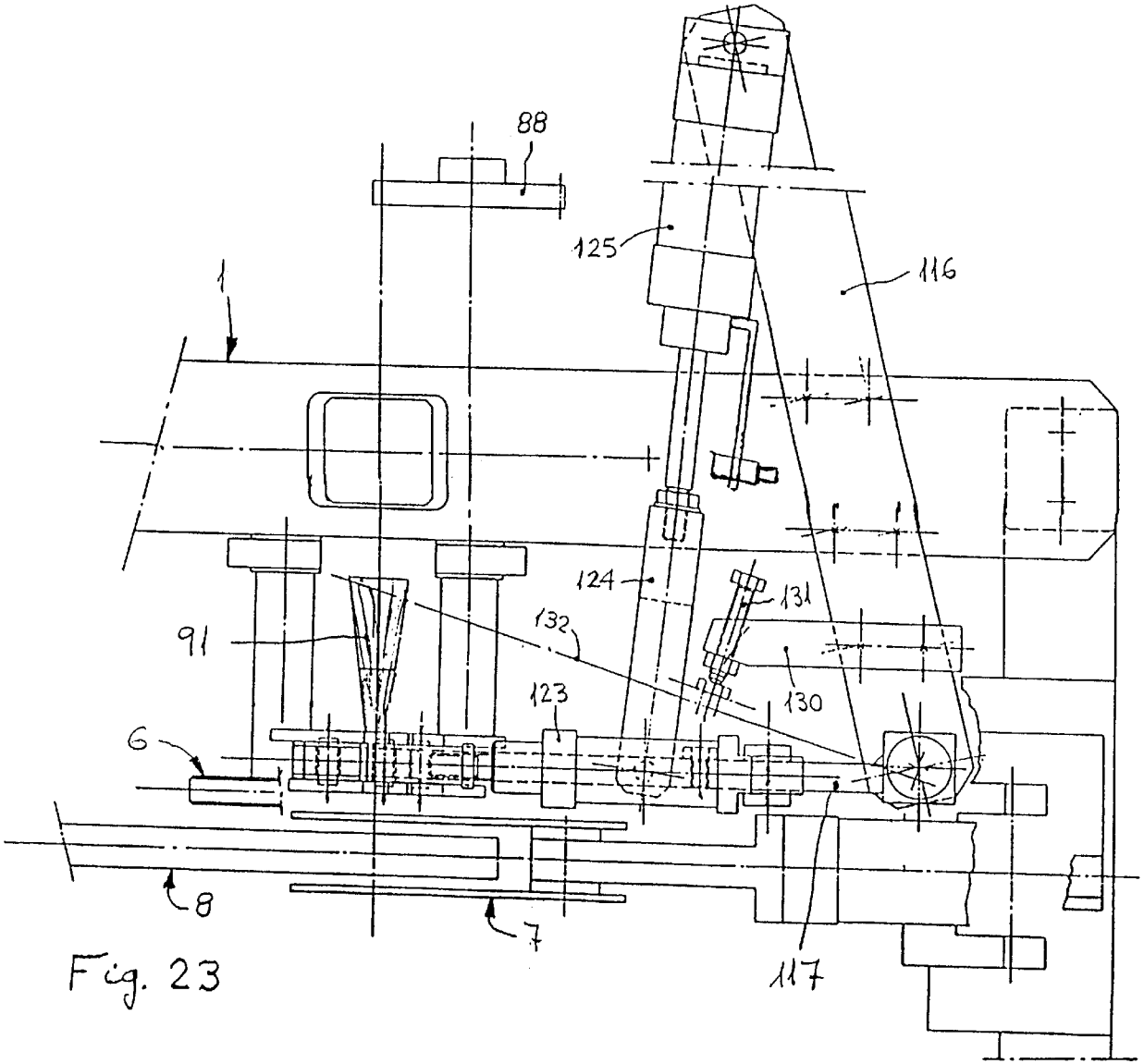
FIG. 23 is a front rear view of a means of securing and elevation in a raised position.
Figure 24:
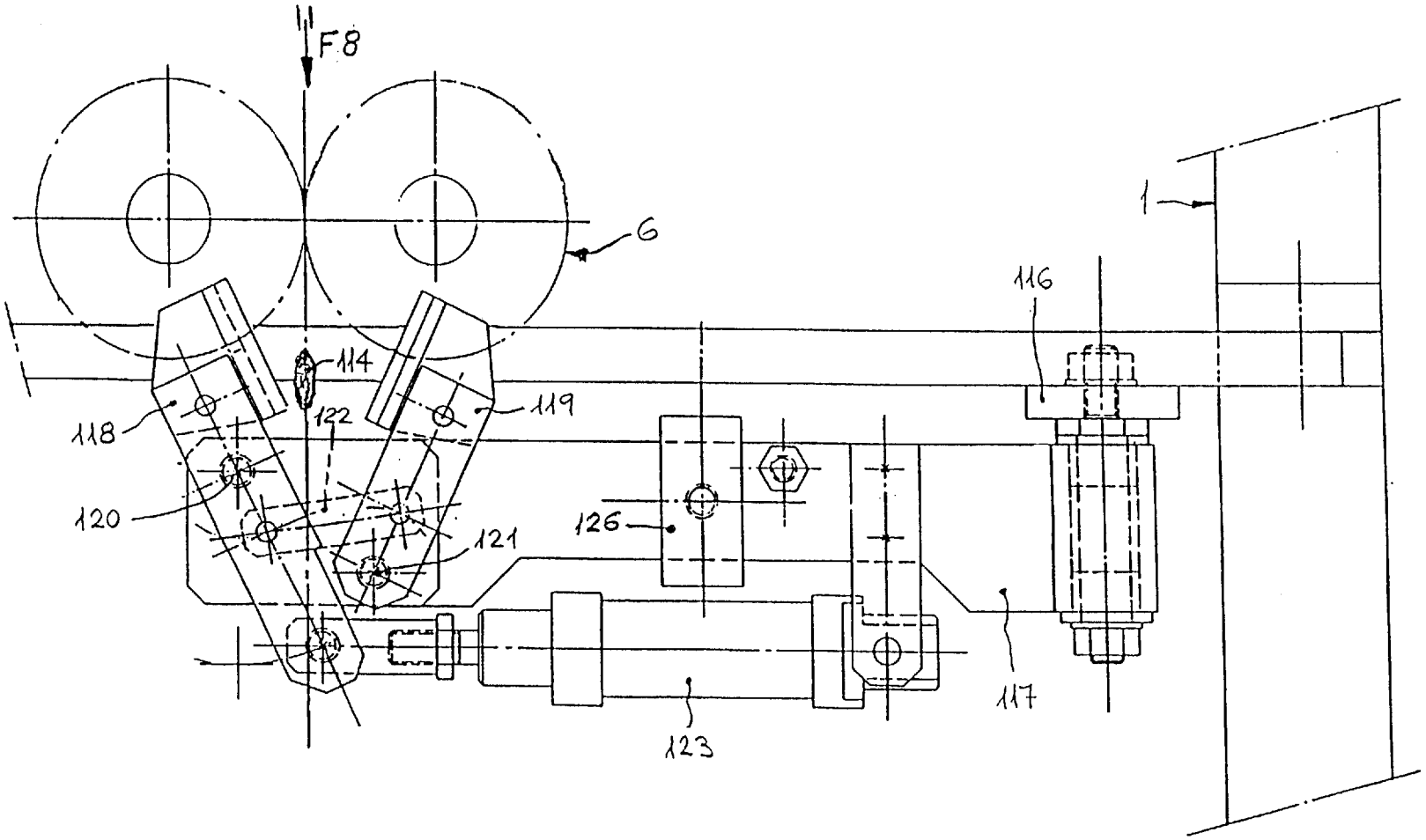
FIG. 24 is an enlarged plan view of the means of securing and elevation of FIG. 23.
Figure 25:
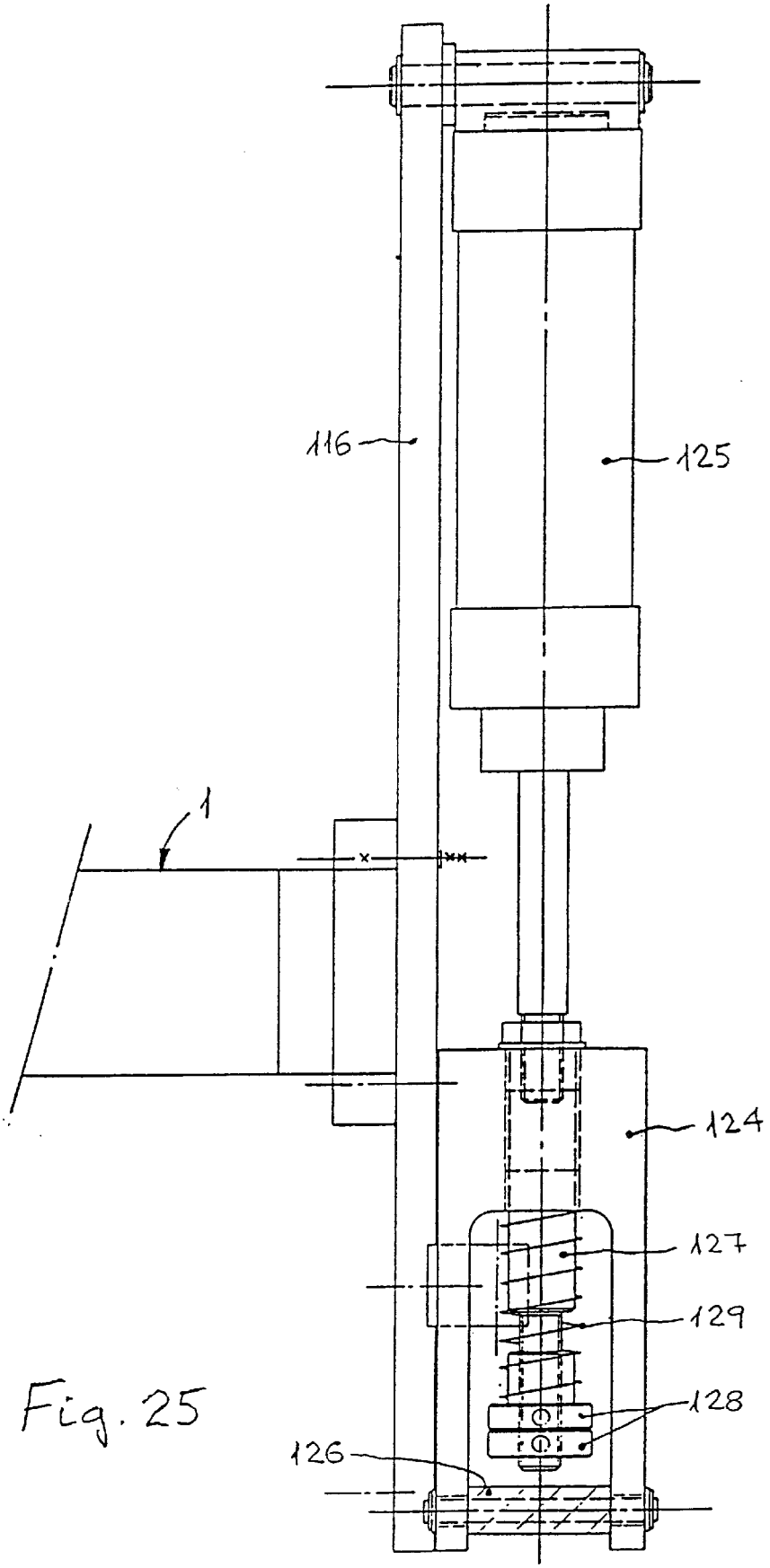
FIG. 25 is an enlarged view of a detail of the means of elevation of FIG. 23.

In the sheet billet (116), a horizontal supplement (130) is fixed where there is a regulatable bumper (131) mounted on its free end, which limits the angular elevation of the support (117) and whose position of maximum elevation of the means of securing and elevation in question is represented in sketch form by the geometric axis (132) in FIG. 23. The nuts (128) allow the previously mentioned spring tension (129) to be regulated, according to the requirements.

Figure 27:
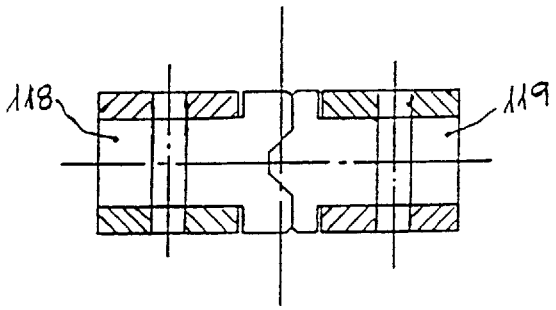
FIG. 27 is a sectional view along line 27—27 of FIG. 26.
Figure 26:
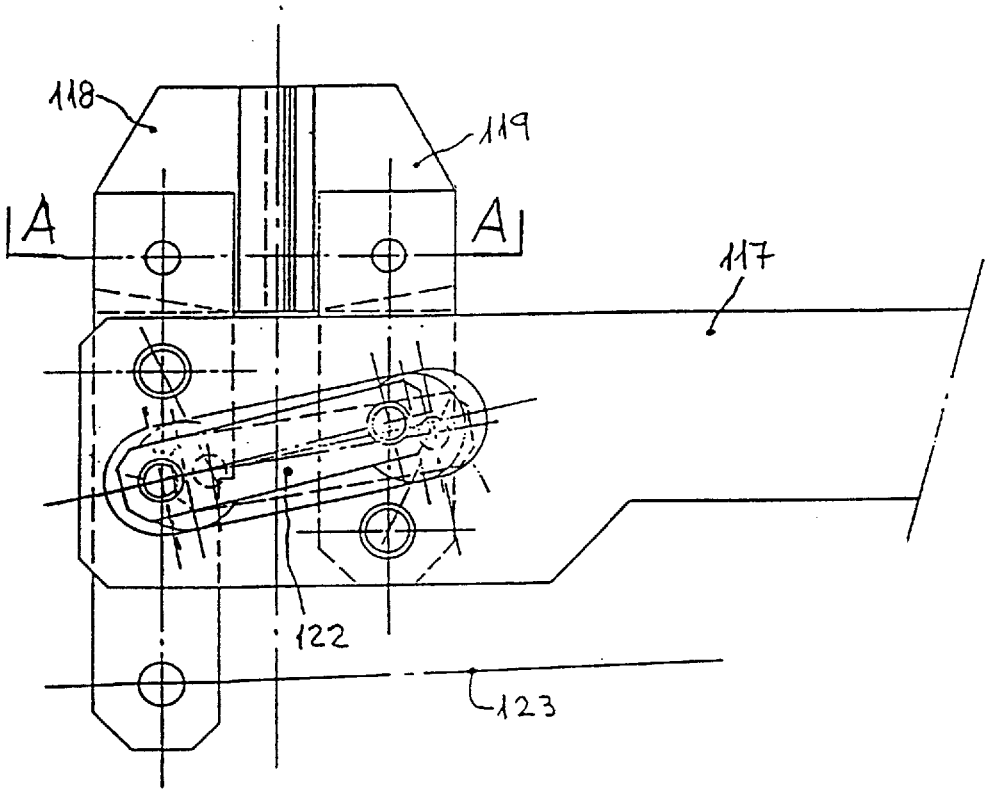
FIG. 26 is an enlarged view of a detail of the securing means of FIG. 24.

FIG. 26 shows the two semi-pincers (118) and (119) in their operational position of closing and between which the upper part of each bag (not shown in FIG. 26) remains secured, and FIG. 27 (which corresponds to section A—A in FIG. 26) shows in detail the configuration of the facing sides of both semi-pincers, with a central entrance in the semi-pincer (118), the corresponding exit in the semi-pincer (119), which is found in said entrance to assure the retention of said upper part of the bag.

The most important operations of the functioning of the bag-packaging machine will now be described in detail:

The bag storage area is filled by placing the rods (16) or (19)—according to their size—of the means of temporary storage (3), superimposing the flange (14) of the frame (12) over the last bag placed so that the upper rim of the first bag rests against the front side of the front pincer (17). The packaging machine is then turned on, producing movement toward the front of the machine, that is, toward the first bag located against the front side of the pincer (17) of the fixed part (46) of the rear pincer (41), whose rotating part (47) is turned upward, and the moment when this fixed part (46) arrives at the first bag there is an intake of air through the openings facing the rear of the bag which remains thus adhered to said fixed part (46) of the rear pincer, which immediately effects a retreat, or moves toward the rear of the machine, opening the mouth of the bag which has passed through the fixed parts of the side pincers (21) and (22), closing the rear pincer by the descent of the rotating part (47); the two side pincers are also closed by the descent of their rotating parts, thus securing the mouth of the bag and enabling at the same time the blowing of air inside the bag to facilitate its corresponding opening and adaptation.

The already weighed product is discharged into the bag, proceeding in this example from a weighing machine (20), whose product passes through a chute (2), filling the bag with the predetermined amount of product. A vibrating operation may be carried out underneath the bag resting on the vibrating platform (35) in order to enhance the distribution of the product inside the bag; this is advisable, especially in the case of bags in which it is desired that the product remain relatively dense and secured in their interior once the bags are closed. At this moment, both side pincers (21) and (22) open and rotate, and the two platforms (78) and (79) join, that is, the upper means of transportation (6) close around the upper part of the bag; the rear pincer (41) opens, and the upper means of transportation (6) turn on at the same time as the lower means of transportation (9), dragging the bag, resting on the continuous belt (29), and separating by moving on the front pincer (17), for which purpose the openings in the rim of the bag come into play. In sum, the already filled bag with the corresponding product is transferred by the upper and lower means of transportation. At this moment, the operations described for the following bag—or second bag from the storage area (3)—begin.

The gathering means (7) act immediately by joining the two pairs of blades (92) and (93) around the upper part of the bag and the closing mechanism (8) of the bag goes into action, placing the corresponding seal around the neck created at the top of the bag; the filled and sealed bag is then transported toward the exit of the machine by the lower means of transportation (9). After the bag is sealed, the second bag goes through the phase of its movement by the means of transportation (6) and (9) according to what was previously highlighted.

In one option of the functioning of the machine, once the already filled bag has been sealed by the closing mechanism (8) of the bag, blowing or impulsion of air is effected toward the rear of the machine, that is, toward the exit of the machine, in an approximately horizontal direction from the rear end of the upper means of transportation (6) toward the upper part or upper tail of the bag, to facilitate the entry of the means of securing and elevation of the upper part of the bag, the part which is placed over the fastening element or sealing tape of the filled and closed bag. Then, said tail is secured by the semi-pincers (118) and (119), such pincers being elevated by elevation of their support (117) for the functioning of the pneumatic cylinder (125) with which it manages to close the bag by gathering it around the set of products contained in the bag and against the action of certain retention by the gathering means (7) and of the closing mechanism (8).

Following this, the closing mechanism (8) is moved along with the open cutting means and temporary securing of the upper part of the bag, semi-pincers (111) and (112) in their open or non-operational position; the bag is then sealed and the previously mentioned means of cutting and temporary securing are closed, that is, the semi-pincer (112) is closed against the semi-pincer (111), resulting in a cut in said tail or upper part of the bag, located over the sealing tape, and this remaining part of the bag is in turn secured. Then the closing mechanism (8) retreats along with said means of cutting and temporary securing of the remaining part of the bag, so that said remaining part that is already cut is driven toward the exit of the machine, at the end of which said means of cutting and temporary securing are opened at the same time that the support (117) descends along with the two semi-pincers (118) and (119), causing air to blow through the blowing means (115), dragging said remainder toward a collector of leftovers, and the filled bag, closed or sealed, gathered tightly around the product it contains and without the upper remainder, the same as with the case of operation initially described, is transported toward the exit of the machine with the transportation means (9) at the same time as the entry into the operational phase of the second bag to be filled.

These highlighted cycles are repeated in one or another of the two options described, thus obtaining the corresponding bags filled with the desired product and closed with sealing tape or another conventional medium.

The means of functioning described (pneumatic cylinders and electromotors) can be any other conventional means, since the machine can have protection devices for the user of the machine, and the functioning of said means of can be effected pneumatically, hydraulically, or by conventional mechanical systems. Also, the necessary means of command for the functioning of the machine will be provided, including means of security, which could be manual or automatic controls and including, if desired, the automatization with the corresponding savings and increase in the yield of the packaging machine referred to. All the operations or operational phases can be controlled, regulated, and sent by adequate electric, pneumatic, hydraulic, electronic, and in some cases, combinations of the same, as a processor of preestablished programs, or to be carried out by the user of the machine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A bag-packaging machine comprising:

a temporary storage at an entrance to the machine for temporarily storing bags to be filled;

means for feeding the bags to the temporary storage;

means for opening and securing a mouth of tho bags, the means for opening and securing include two pairs of pincers located generally in vertical planes perpendicular to each other, the pincers of each pair being opposed to one another and one of the vertical planes generally coinciding with a central longitudinal plane of the machine, the two pairs of pincers including a front pincer, a rear pincer and two side pincers, the front pincer being fixed and having two horizontal generally parallel rods pointed toward the entrance to the machine and providing means for hanging the bags to be filled, the bags hanging from an opening in a protruding upper rim of each bag, the front pincer further having a vertical flange with two oblique flaps diverging toward the rear pincer, a mobile part, joined on a respective horizontal axis, of the rear pincer and the two side pincers includes a vertical flange with two oblique flaps diverging toward the opposite pincer, the flange of the front pincer and the flanges of the mobile parts of the three remaining pincers forming an octagonal shape with a central vertical axis;

means for mounting the four pincers to simultaneously and synchronistically regulate a distance between the pincers and the central vertical axis of said octagonal shape, the central axis of the octagonal shape remaining fixed;

means for discharging products into the bags comprising a foldable chute, the chute being superimposed over the opening to the bag in the temporary storage and the chute being generally centered with respect to a central vertical axis through the bag, the chute including means for attaching the chute to the machine;

means for transferring filled bags from the temporary storage;

means for tightening a neck of the filled bag;

means for closing the bag with a fastening element; and means for transporting filled and closed bags toward an exit of the machine.

2. The bag-packaging machine in accordance with claim 1, further comprising:

means for securing and elevating an upper part of the filled and closed bag, the means for securing and elevating moving the bag over the means for closing; and means for cutting and temporarily securing the upper part of the bag.

* * * * *